US006600387B2

(12) United States Patent
Cook et al.

(10) Patent No.: US 6,600,387 B2
(45) Date of Patent: Jul. 29, 2003

(54) MULTI-PORT MULTI-BAND TRANSCEIVER INTERFACE ASSEMBLY

(75) Inventors: Scott J. Cook, Garner, NC (US); Peter L. Gardner, Apex, NC (US)

(73) Assignee: Channel Master LLC, Smithfield, NC (US)

( * ) Notice: Subject to any disclaimer, the term of this patent is extended or adjusted under 35 U.S.C. 154(b) by 0 days.

(21) Appl. No.: 09/836,407

(22) Filed: Apr. 17, 2001

(65) Prior Publication Data

US 2002/0153964 A1 Oct. 24, 2002

(51) Int. Cl.[7] ..... H01P 5/00
(52) U.S. Cl. ..... 333/126; 333/135; 333/137
(58) Field of Search ..... 333/126, 125, 333/21 A, 135, 137

(56) References Cited

U.S. PATENT DOCUMENTS

| | | | | |
|---|---|---|---|---|
| 3,435,380 A | | 3/1969 | Billon et al. | 333/21 |
| 3,731,236 A | | 5/1973 | Di Tullio et al. | 333/9 |
| 4,162,463 A | * | 7/1979 | DiTullio et al. | 333/117 |
| 4,231,000 A | * | 10/1980 | Schuegraf | 333/109 |
| 4,293,829 A | * | 10/1981 | Schuegraf | 333/125 |
| 4,319,206 A | * | 3/1982 | Schuegraf | 333/126 |
| 4,467,294 A | * | 8/1984 | Janky et al. | 333/126 |
| 4,700,154 A | * | 10/1987 | Schuegraf | 333/125 |
| 5,003,321 A | * | 3/1991 | Smith et al. | 343/781 R |
| 5,384,557 A | | 1/1995 | Yoshida et al. | 333/21 A |

FOREIGN PATENT DOCUMENTS

DE 2459045 1/1976

* cited by examiner

*Primary Examiner*—Robert Pascal
*Assistant Examiner*—Dean Takaoka
(74) *Attorney, Agent, or Firm*—Darby & Darby

(57) ABSTRACT

According to the present invention, a waveguide assembly is provided and includes a common input waveguide aligned along a first axis. The input waveguide supports two frequency bands and one or more polarities, namely high and low band signals of two polarities which are typically supplied using a feed horn which is coaxially aligned with the input waveguide. The waveguide assembly also includes an output waveguide for supporting and discharging the low band signal (one or more polarities). The output waveguide extends along a second axis which is parallel to the first axis containing the input waveguide but is displaced therefrom. In order to accomplish this the waveguide assembly has two or more waveguides connecting the input waveguide to the output waveguide. The waveguides are disposed substantially perpendicular to the input and output waveguides such that the low band signal is fed into the input waveguide and then separated therefrom by being carried within one or more planes defined by the waveguides before being discharged through the output waveguide.

44 Claims, 15 Drawing Sheets

MULTI-PORT MULTI-BAND TRANSCEIVER INTERFACE ASSEMBLY

TECHNICAL FIELD

This invention is related to a waveguide device which supports multiple signals having varying frequencies and polarities. More specifically, this invention relates to a multi-port multi-band transceiver interface assembly in which signals having a first band with one or more polarities are separated from second band signals (having one or more polarities) where the second band signals are supported by a waveguide structure having an input port and an output port which lie substantially in the same plane which is generally perpendicular to an input feed for the first and second bands.

BACKGROUND OF THE INVENTION

As technology advances, an increasing number of reflector antenna applications, including satellite and other antenna type applications, require complex multi-port (4 or more) assemblies to support the multiple polarities and multiple frequency band signals that are used in such assemblies. Typically, these assemblies are referred to as waveguides. The complexity increases and certain difficulties arise when in addition to the input port in which the signals are all received, these systems also further require signals having multiple polarities to be transmitted and signals having multiple polarities to be received. For example, the system may require transmitting on 2 polarities and receiving on 2 polarities at the same time.

In response to such needs, assemblies have been developed to process such signals; however, these conventional assemblies have a number of associated deficiencies. For example, the conventional assemblies have been very costly and also have degraded performance in the form of degraded cross polarity rejection. In addition, these assemblies are typically inconveniently packaged and a mechanically bulky which causes the assemblies to be difficult to install and difficult to adjust the polarity. For example, four-port combiner devices with symmetric branching are available. These devices typically include a common port in which two input bands (high and low frequency) are inputted into the input port and then separated from one another. The low band is separated from the high band by using four lower ports which separate the two polarities of the low band. Thus, two lower ports are used for each polarity and the respective bands are sent upwards within four separate symmetric waveguide members. These four separate waveguide members comprise elongated members which each share a common axis with the input signal so that symmetry of the signals is maintained. Because the device has multiple ports, the device is relatively very long and mechanically complex because the feed antenna is connected to the common port such that it lies along the same axis as the transmit or receive elements. This results in a bulky assembly which is unsuitable for many applications. Other conventional assemblies have designs which require the heavy transmit radio to be mounted off the center feed horn axis, making it more difficult to support, and adjust, and less aesthetically attractive. Some assemblies which are compact and keep the transmitter in-line with the feed horn suffer from reduced performance due to asymmetries in the design of these assemblies. For example, some of these assemblies are somewhat limited to dual band applications where the two frequency bands are separated a considerable band width apart from one another. This limits the scope of application of the assembly.

Accordingly, it is desirable to provide a waveguide assembly having a common port which supports band signals having different frequency bands and each containing one or more polarities, wherein one of the band signals is separated from the other band signal in a manner which permits the design of the assembly to be compact and symmetric.

SUMMARY OF THE INVENTION

According to one embodiment of the present invention, a waveguide assembly is provided and includes a common input waveguide aligned along a first axis. The input waveguide supports two frequency bands each having one or more polarities. The frequency bands, namely high and low band signals, are typically supplied using a feed horn which is coaxially aligned with the input waveguide. The input waveguide preferably includes coaxial inner and outer members with the inner member being configured to carry a high band signal (one or more polarities). The inner member is constructed so that the high band signal is carried and passed straight through the inner waveguide preferably without any separation between the one or more polarities. The outer member supports the low band signal having one or more polarities.

The waveguide assembly includes an output waveguide for supporting and discharging the low band signal (one or more polarities). The output waveguide extends along a second axis which is parallel to the first axis containing the input waveguide but is displaced therefrom. In other words, the low band signal is received at one location and discharged at a second location spaced therefrom but axially aligned therewith. In this manner, the low band signal is separated from the high band signal and carried to the output waveguide where it is discharged from the waveguide assembly.

In order to accomplish this the waveguide assembly, according to one embodiment, has first and second waveguides connecting the input waveguide to the output waveguide. The first and second waveguides are disposed substantially perpendicular to the input and output waveguides such that the low band signal is fed into the outer member and then separated therefrom by being carried within one or more planes defined by the first and second waveguides before being discharged through the output waveguide.

Accordingly, the present invention provides a waveguide assembly which is compact and preferably symmetric in nature so that the phase of the low band signal does not change as measured at the input waveguide and the output waveguide. In this way, the phase length and orientation of the first and second waveguides are carefully controlled so that a phase difference does not result. In other embodiments, the first and second waveguides may be configured so as to introduce a phase difference if this is desired in a given application. In contrast to conventional waveguide devices, the first and second waveguides preferably lie within one or more planes which are substantially perpendicular to both the input and output waveguides and therefore the present waveguide assembly may be conveniently sandwiched between two components, e.g., the feed horn and a radio, during use of the waveguide assembly. This is in contrast with conventional devices which comprise elongated structures aligned along the same axis as the feed horn and the other component, such as the radio.

In one embodiment, the assembly also includes third and fourth waveguides in which the first, second, third, and fourth waveguides intersect one another at a first location and at a second location. The first location is where the input waveguide is coupled to each of the waveguides and the second location is where the output waveguide is coupled to each of the waveguides. The different polarities of the low band signal are separated from one another at the first location by being launched into a number of paths which each connects the input waveguide to the output waveguide. Next adjacent paths are spaced at a predetermined angle relative to one another and preferably, the predetermined angle is 90° so that one polarity is carried within one path and the other polarity is carried within the path which has a 90° orientation therefrom.

In this exemplary embodiment, each waveguide defines a respective path and has a phase length associated therewith. The paths are spaced apart so as to support both the first and second bands. The first and third paths, which are preferably spaced 180° apart, carry the same polarity low band signal and the second and fourth paths, also spaced 180° apart, carry the other polarity low band signal. The paths which are spaced 90° apart therefore carry low band signals of different polarity. It is generally preferable to not introduce a phase difference between the different polarity low band signals as the signals are carried through the waveguide assembly. In order to accomplish this the phase length and orientation of the waveguides are carefully tailored so as to maintain a level of symmetry.

In one aspect of the invention, the different polarity low band signals are launched into respective waveguides in the same first plane in which the signals are later recombined before being discharged through the output waveguide. Because the signals are launched and recombined in the same first plane, a level of symmetry is achieved. In addition and importantly, the phase lengths of each waveguide is preferably equal to the others so as to also introduce further symmetry into the waveguide assembly. In several embodiments, the waveguides have a cross-over orientation which permits the phase lengths of each waveguide to be equal to one another. At locations other than the first and second intersections where the first waveguide member crosses over the second waveguide, each of the first and second waveguides includes a bridge-like section which extends out of its plane and permits the other of the first and second waveguides to pass thereunderneath. After the respective first or second waveguide passes thereunderneath, the respective waveguide returns to its plane and continues on to the output waveguide. This design achieves equal phase lengths resulting in greater symmetry introduced into the waveguide assembly, while keeping the first and second waveguides within a defined plane. A similar configuration for the third and fourth waveguides is provided.

In other embodiments according to the present invention, the phase lengths and/or structures of the waveguides may be altered so as to introduce a phase difference between the first polarity paths and the second polarity paths.

Other features and advantages of the present invention will be apparent from the following detailed description when read in conjunction with the accompanying drawings.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
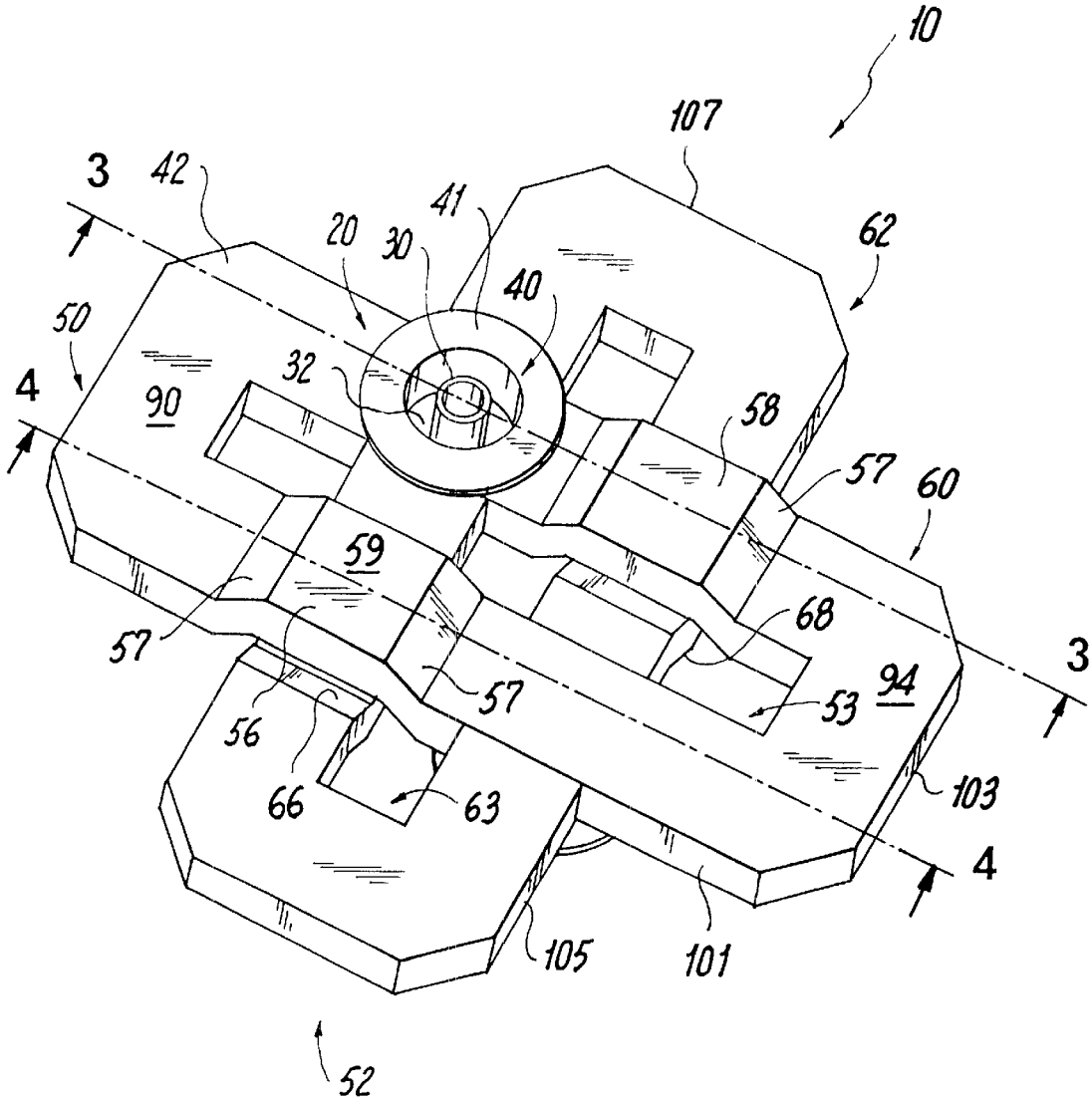
FIG. 1 is a top perspective view of a waveguide assembly according to a first embodiment.
Figure 2:
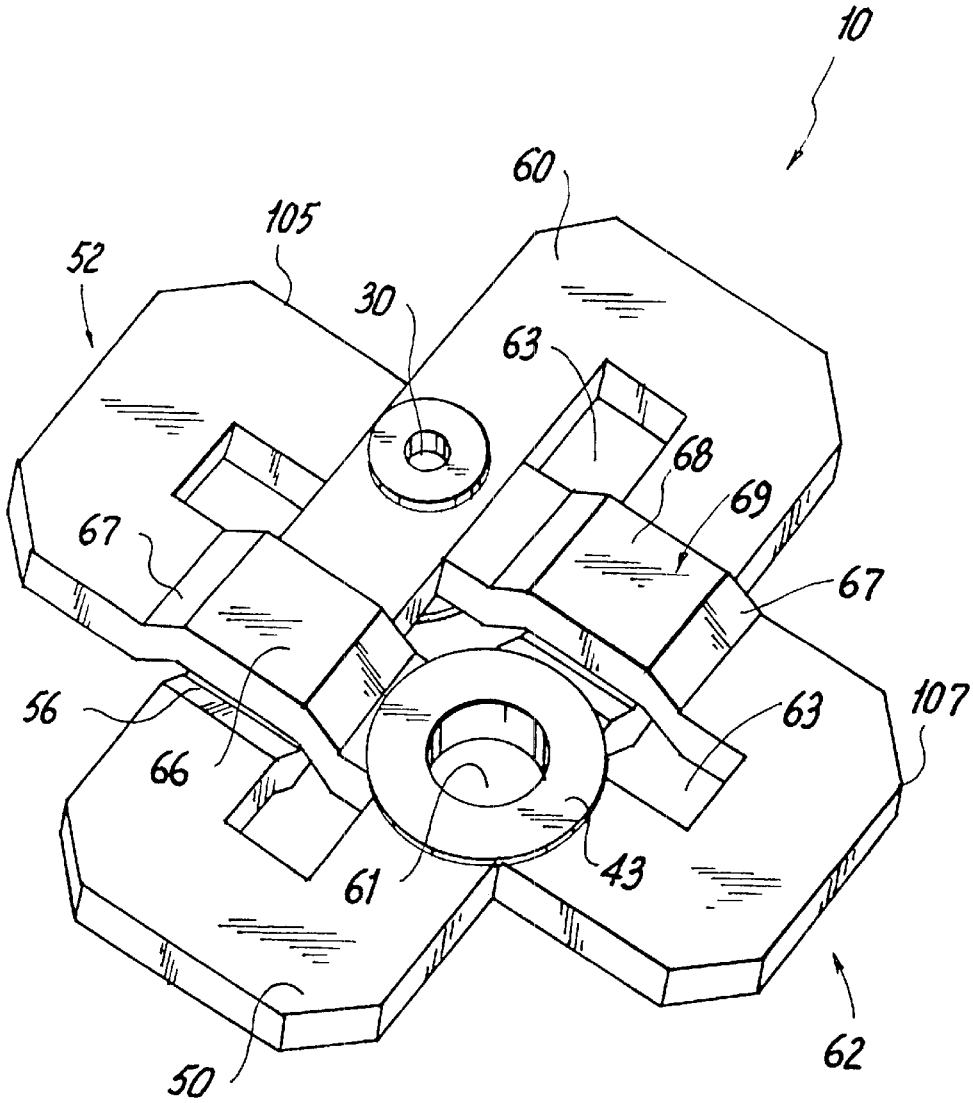
FIG. 2 is a bottom perspective view of the waveguide assembly of FIG. 1.

Referring first to FIGS. 1–2, a multi-port multi-band waveguide assembly according to a first embodiment of the present invention is illustrated and generally indicated at 10. The waveguide assembly 10 may also be referred to as a transceiver device which is capable of both transmitting and receiving signals.

According to a first embodiment of the present invention, the waveguide assembly 10 has an input port 20 formed of an outer guide member 40 and a concentric inner guide member 30. The input port 20 generally comprises a waveguide aligned along a common axis, which is suitable for carrying at least first and second band signals each having one or more polarities. For example, the input port 20 preferably comprises a dual band coaxial waveguide which carries both the first and second band signals. In one exemplary embodiment, the first band signal comprises high band signals which are those signals having a higher frequency band than the second band signal which comprises low band signals. It will be appreciated that the high band signals typically have one or more different polarities (e.g., 2 polarities) and the low band signals typically have one or more polarities (e.g., 2 polarities). Typically, the low band signals comprise receive signals and the high band signals comprise transmit signals; however, the opposite may equally be true.

In the exemplary embodiment illustrated in FIGS. 1–5, the high band signals are carried within the inner guide member 30 which in this embodiment comprises a guide member which is concentrically disposed within the outer guide member 40. The inner guide member 30 is thus designed to support high band signals having several polarities and as is known in the art, the inner guide member 30 may have a dielectric material disposed between the walls thereof. A gap 32 is formed between the outer guide member 40 and the inner guide member 30 and preferably, the gap 32 is preferably free of any material so that only air occupies this area between the members 30, 40. It will be understood that a dielectric material may be added with the gap 32. The low band signals are actually carried within the gap 32 between the inner guide member 30 and the outer guide member 40. In the exemplary embodiment, each of the inner and the outer guide members 30, 40 has an annular cross-sectional shape. It will be appreciated that the inner and outer guide members 30, 40 are not limited to having an annular shape and may have a number of alternative shapes, such as oval and rectangular. Depending upon the precise application and more specifically depending upon the difference in the frequency bands of the signals, the shape and the size of the inner and outer guide members 30, 40 are preferably selected in view of these parameters.

The input port 20 is designed to serve as an interface between the waveguide 10 and a feed horn (not shown) which may comprise a broad band, a multi band, or a dual band feed horn. The low and high band signals are received, i.e., through the feed horn, and channeled into the input port 20. The feed horn is complementary to the input port 20 in that the feed horn is designed to support signals having several frequency bands and one or more polarities. One exemplary type of feed horn comprises a coaxial feed horn having a polyrod feed extending through a center portion thereof. In other words, the feed horn has two feeds along the same axis and is designed to mate with the waveguide 10 of the present invention so that the first band signals are fed into the inner waveguide 30 and the second band signals are fed into the outer waveguide 40. It will be understood that the high band signal supported by the inner guide member 30 comprise high band signals having a first polarization, designated as "V" and centered about f(2) with wavelength λ(v) and a second polarization, designated as "H" and centered about f(2) with wavelength λ(h).

FIG. 1 is a top perspective view of the waveguide structure 10 and FIG. 2 is a bottom perspective view of the waveguide 10 according to the first embodiment. The waveguide 10 includes a first waveguide 50, a second waveguide member 52, a third waveguide 60, and a fourth waveguide 62 which serve to support both the first and second polarity low band signals. More specifically, the first and third waveguides 50, 60 are suitable for carrying low band signals having a first polarization, designated as "V" and centered about frequency f(v) with wavelength λ(v). The second waveguide 52 and the fourth waveguide 62 are suitable for carrying low band signals having a second polarization, designated as "H" and centered about f(h) with wavelength λ(h). It will be appreciated that according to the present invention, f(v) may be the same or different from f(h). According to the present invention, the outer waveguide member 40 is actually formed of two separate sections, namely an input section 41 and an output section 43. The input section 41 is coaxial with both the feed horn and the inner waveguide member 30. In addition, the input section 41 is formed at a first intersection, generally indicated at 51 (best shown in FIG. 5), between the members 50, 60.

The output section 43 is disposed at a second intersection, generally indicated at 61 (FIG. 2), between the members 50, 60. The output section 43 extends along an axis which is generally parallel to the axis of the input section 41 with the axis of the output section 43 being displaced from the axis of the input section 41. The output section 43 extends away from the member 50 in an opposite direction relative to the input section 41 which likewise extends away from the member 50.

Each of the waveguides 50, 52, 60, 62 comprises a member which is shaped and cooperates with one another to define paths for carrying the H and V polarity low band signals. After having been fed into the outer waveguide member 40 from the feed horn, the low band signals are separated into one of the respective waveguides 50, 52, 60, 62 at the first intersection 51 and combined at the second intersection 61 between the waveguides 50, 52, 60, 62. More specifically, the first and third waveguides 50, 60 form a substantially closed structure which is generally in the shape of a rectangle. Each of the exemplary first and third waveguides 50, 60 has a generally rectangular cross section and comprises a hollow member to permit the low band signals to travel though the paths defined thereby.

The first and third waveguides 50, 60 preferably form a symmetric structure which includes opposing side portions 101 and opposing end portions 103 which extend between the side portions 101. The side and end portions 101, 103 are preferably integrally formed with respect to one another so that the waveguides 60, 60 form a unitary structure. According to the first embodiment, the side and end portions 101, 103 lie within a first plane. The first waveguide 50 has a first bridge portion 56 formed therein and the third waveguide 60 has a second bridge portion 58 formed therein. The first and second bridge portions 56, 58 each comprises a raised portion of the waveguides 50, 60, respectively, relative to the remaining portions of the waveguides 50, 60 such that the first and second bridge portions 56, 58 do not lie within the first plane.

Each bridge portion 56, 58 includes a pair of beveled sections 57 which cause a section of the respective side portion 101 to extend out of the first plane. The beveled sections 57 level off to define a planar section 59 extending therebetween. The planar section 59 lies in a second plane which is different from the first plane defined by the surrounding sections of the side portions 101 and end portions 103. However, the second plane defined by the planar section 59 is preferably parallel to the first plane. In the exemplary embodiment, the shape of the first and third waveguides 50, 60 define a generally rectangular opening 53 formed between the side and end portions 101, 103.

The second and fourth waveguides 52, 62 also preferably form a symmetric member which preferably has an essentially identical configuration as the first and third waveguides 50, 60. The second and fourth waveguides 52, 62 form a generally rectangular shaped structure which includes opposing side portions 105 and end portions 107 extending therebetween. The side and end portions 105, 107 lie within the first plane. The second waveguide 52 has a first bridge portion 66 formed therein and the fourth waveguide 62 has a second bridge portion 68 formed therein. The first and second bridge portions 66, 68 each comprises a raised portion of the waveguides 52, 62 relative to the remaining portions of the member 60 such that the first and second bridge portions 66, 68 do not lie within the first plane.

Each bridge portion 66, 68 includes a pair of beveled sections 67 which cause the respective side portion 105 to extend out of the first plane. The beveled sections 67 level off to define a second planar section 69 extending therebetween. The planar section 69 lies in the second plane which is preferably parallel to the planar section 59. A generally rectangular opening 63 is similarly formed between the side and end portions 105, 107.

The waveguide assembly 10 is designed so that the first, second, third, and fourth waveguides 50, 52, 60, 62; the input port 20; and other components thereof are carefully arranged to provide a specific symmetric and functional orientation therebetween. More specifically, the waveguides 50, 52, 60, 62 are coupled with one another so that they intersect one another at the first and second intersections 51, 61. In the exemplary embodiment, the waveguides 50, 52, 60, 62 are coupled to one another so that the side portions 101 are generally perpendicular to the side portions 105. The first bridge 56 is disposed over the first bridge 66 with the beveled sections 57, 69 extending in opposing directions such that the first, second, third, and fourth waveguides 50, 52, 60, 62 pass over one another before returning to the first plane. Because the waveguides 50, 52, 60, 62 lie within the same first plane at the first and second intersections 51, 61, the waveguides 50, 52, 60, 62 are preferably integrally connected at these locations. In other words, each of the first and second intersections 51, 61 comprises a four-way intersection where the waveguides 50, 52, 60, 62 converge and intersect.

Figure 3:
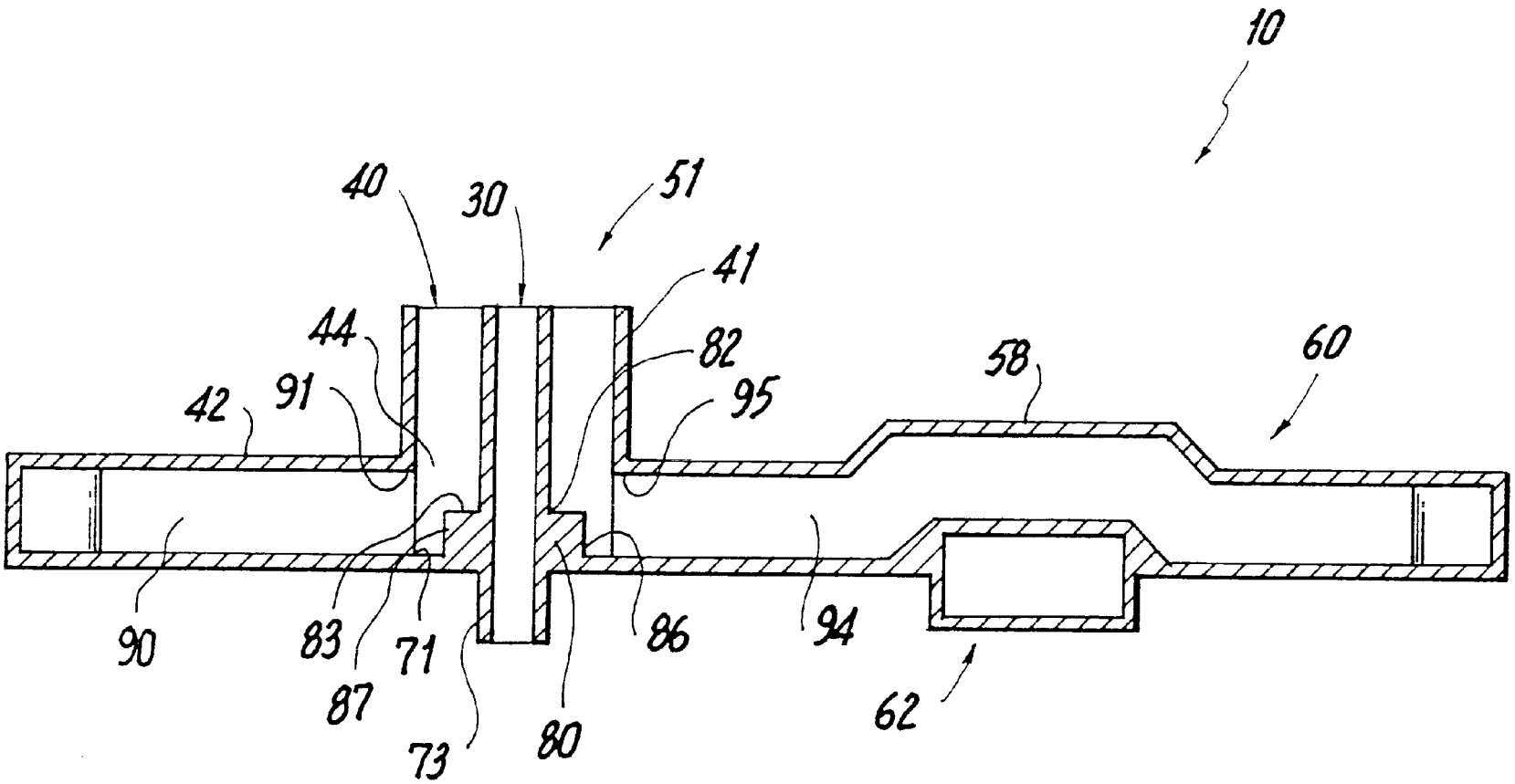
FIG. 3 is a cross-sectional view of the waveguide assembly taken along the line 3—3 of FIG. 1.

At the first intersection 51, the assembly 10 has an aperture 44 formed in the outer surface 42 of the assembly 10. The aperture 44 has a similar or identical shape as the periphery of the outer waveguide member 40 (best shown in FIG. 3). The aperture 44 permits the low band signals to be channeled in from the feed horn between the inner and outer waveguide members 30, 40. As best shown in FIGS. 1 through 3, the inner waveguide member 30 comprises a tubular member which extends axially through the first intersection 51. The inner waveguide member 30 is structurally attached to the waveguide assembly 10 by being connected to a bottom wall 71. A section 73 of the inner waveguide member 30 extends through the bottom wall 71. This section 73 serves as a outlet member for the inner waveguide member 30 and either receives or transmits the V and H polarity high band signals depending upon the precise application of the waveguide assembly 10. Section 73 also serves as a coupling structure to attach the waveguide assembly 10 to another component such as a radio (not shown). The inner waveguide member 30 thus extends uninterrupted along a single axis, while the outer waveguide member 40 is broken into two sections, namely the input and output sections 41, 43. In the exemplary embodiment, the output section 43 is diagonally opposed to the input section 41. It will be appreciated that the inner waveguide member 30 along with the input section 41 of the outer waveguide member 40 are coaxial to the feed horn, while the output section 43 is not.

As illustrated in FIGS. 1 through 4, the four bridges 56, 58, 66, 68 of the waveguide assembly 10 are designed to cooperate so that the first waveguide 50 passes over the second waveguide 52 and the third waveguide 60 passes over the fourth waveguide 62, while the majority of the assembly 10, including the first and second intersections 51, 61 lie substantially within the same first plane. One will appreciate that the waveguides 50, 52, 60, 62 support the low band signals in the first plane which is substantially perpendicular to the axial plane of both the input port 20 and the feed horn. This is in contrast with configurations of conventional combiner equipment which use multiple ports to separate the low band signals; however, the signals are carried within elongated members which are axially aligned with the axis of the feed horn.

According to the present invention, the V and H polarity low band signals are launched into one of four waveguide paths which branch away from the first intersection 51 and then converge at the second intersection 61 where the signals are combined prior to being carried out of the waveguide 10 by means of the output section 43. The branching of the low band signals into the four paths preferably occurs within the same first plane. The first and third waveguides 50, 60 define two paths and the second and fourth waveguides 52, 62 define the other two paths. More specifically, the first waveguide 50 defines a first path 90, the second waveguide 52 defines a second path 92, the third waveguide defines a third path 94, and the fourth waveguide 62 defines a fourth path 96 (best shown in FIG. 5). It will be understood that the branching of the low band signals into the four paths may occur within different planes so long as the first and third waveguides are in one plane and the second and fourth waveguides are in another plane. In other words, the launching sites for the V and H polarity low band signals may be in different planes and the later recombining of the low band signals may also take place in different planes.

Figure 5:
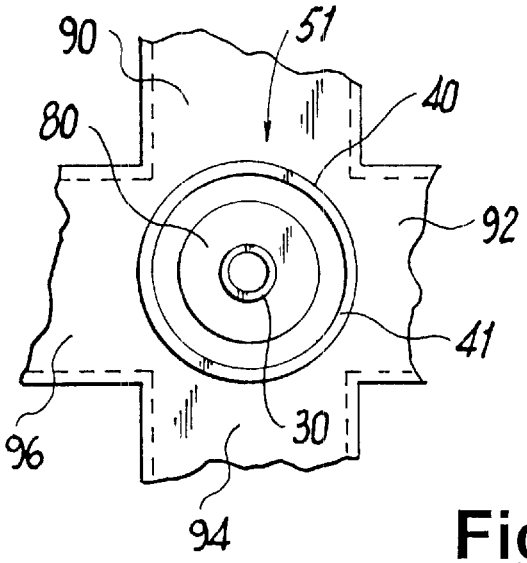
FIG. 5 is a top plan view of a first intersection of the waveguide assembly of FIG. 1.

Now referring specifically to FIGS. 3 and 5 in which the first intersection 51 is shown in greater detail in the cross-sectional view of FIG. 5. The input section 41 extends from the outer surface 42 of the member 50 with the inner waveguide member 30 extending through the opening formed between the outer waveguide member 40. The section 73 extends from the bottom wall 71. The inner waveguide member 30 is further supported by an annular support member 80 which is preferably integrally formed with both the inner waveguide member 30 and the bottom wall 71. The annular support member 80 forms a stepped configuration at the first intersection 51 in that a first shoulder 82 is formed where an upper surface 83 of the annular support member 80 intersects the inner waveguide member 30. A second shoulder 86 is formed where a side surface 87 intersection the bottom wall 71. Preferably, the side surface 87 is perpendicular to the bottom wall 71. As will be described in greater detail, the annular support member 80 also serves as a means for directing the V and H polarity low band signals into one of the respective waveguide paths 90, 92, 94, 96.

The first intersection generally comprises a four-way intersection defined by the four paths 90, 92, 94, 96 with adjacent paths being formed at a right angle relative to one another. The first and third paths 90, 94 are preferably formed opposite one another (i.e. 180° apart) and the second and fourth paths 92, 96 are preferably formed opposite one another (i.e. 180° apart). For purposes of illustration only, the first and third paths 90, 94 will be described in greater detail; however, it will be understood that the discussion applies similarly to the second and fourth paths 92, 96. The first and third paths 90, 94 are coupled to the input port 20 by suitable coupling apertures 91, 95, respectively, proximate to the annular support platform 80. Apertures 91, 95 are configured to pass signals of a given polarity, such as the signals having the first polarization (V polarity) when the waveguide 10 is properly aligned with the plane of polarization of the signal. The apertures (not shown) which couple the second and fourth paths 92, 96 to the input port 20 are configured to pass signals of a given opposite polarity, such as the signals having the second polarization (H polarity) when the waveguide assembly 10 is properly aligned with the plane of polarization of the signal. The plane of polarization may represent either the magnetic or electric field, depending upon the type of coupling aperture utilized. Designs for coupling apertures of this type are well known to those skilled in the art. The respective waveguides 50, 52, 60, 62 are also designed to carry such polarized signals. In the embodiment where the signals having the first polarization are launched from a different plane than the signals having the second polarization, the apertures 91, 95 and the apertures for the paths 92, 96 are in different planes, e.g., one set of apertures may be slightly above or below the other set of apertures.

Now referring to FIGS. 1 through 5, the annular support platform 80 and bottom wall 71 serve to direct the low band signals into the respective coupling aperture and waveguide paths 90, 92, 94, 96. The first waveguide 50 extends from the first intersection 51 to the second intersection 61 and includes the first bridge 56 and the third waveguide 60 extends from the first intersection 51 to the second intersection 61 and includes the second bridge 58. According to the present invention, the phase lengths of each of the first and third waveguides 50, 60 are the same so as to maintain symmetry relative to the separation and later recombination of the low band signals having V polarity. The symmetry is also preserved by first launching (separating) the V polarity low band signals at the first intersection 51 and then combining the signals in the same plane at the second intersection 61, while maintaining the phase lengths.

Similarly, the second waveguide 52 extends from the first intersection 51 to the second intersection 61 and includes the first bridge 66 and the fourth waveguide 62 extends from the first intersection 51 to the second intersection 61 and includes the second bridge 68. According to one embodiment of the present invention, the phase lengths of each of the second and fourth waveguides 52, 62 are preferably the same so as to maintain symmetry relative to the separation and later recombination of the low band signals having H polarity. The symmetry is also preserved by first launching (separating) the H polarity low band signals at the first intersection 51 and then recombining the signals in the same plane at the second intersection 61. In other words, the phase lengths of the first, second, third, and fourth waveguides 50, 52, 60, 62 are preferably the same. The equal phase length is achieved by crossing the waveguides 50, 52, 60, 62 over one another using multiple bridges 56, 58, 66, 68 at points of cross-over. This ensures that the signals are launched and recombined in the same first plane while the phase lengths remain equal. At the first intersection 51, the two opposing band signal launches that make up one polarity must be in the same plane, but the two sets (one H and one V) do not necessarily have to be in the same plane. As previously mentioned, the launching of the H polarity signals and the launching of the V polarity signals may be in different planes. It will be appreciated that a cross-sectional view taken along the first intersection and including the first bridge 66 of the second waveguide 52 will be symmetric to the view shown in FIG. 3.

Figure 4:
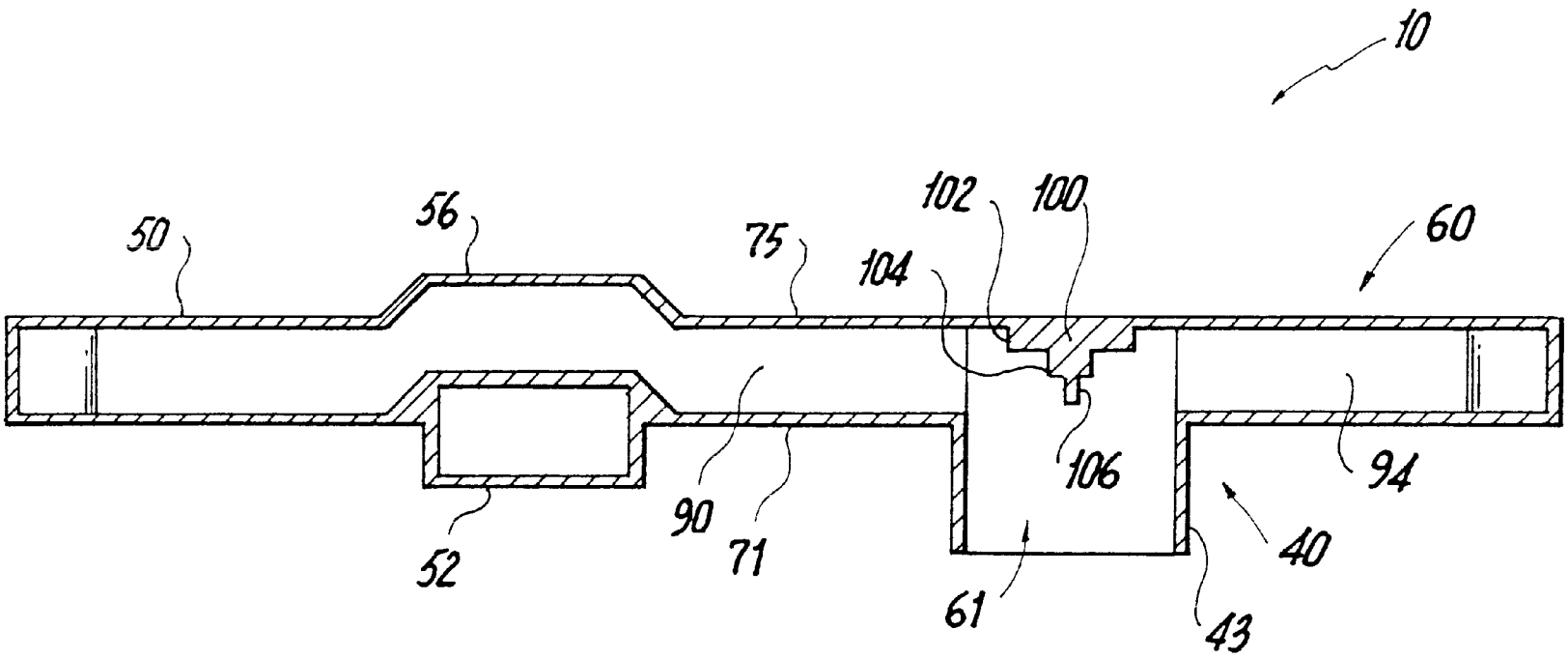
FIG. 4 is a cross-sectional view of the waveguide assembly taken along the line 4—4 of FIG. 1.

Referring now to FIG. 4 which illustrates the second intersection 61 of the waveguide 10. While FIG. 4 illustrates a cross-sectional view including the first bridge 56 of the first waveguide 50, it will be understood that a cross-sectional view of the second intersection 61 along the second and fourth waveguides 52, 62 and including the second bridge 68 will be symmetric to the view shown in FIG. 4. The second intersection 61 comprises the location in the waveguide 10 where the V and H polarity low band signals are recombined from the first, second, third, and fourth paths 90, 92, 94, 96 and then directed through the output section 43 of the outer waveguide member 40 in a manner such that the discharge of the recombined signals is along an axis parallel to the axis of the input section 41 but displaced therefrom.

The second intersection 61 includes the second section 43 of the outer waveguide member 40 which extends outwardly from the bottom wall 71. The second intersection 61 also includes a member, generally indicated at 100, which serves to direct the V and H polarity low band signals from the first, second, third, and fourth paths 90, 92, 94, 96 into the second section 43. One exemplary member 100 comprises a generally annular structure formed of a number of stepped annular platforms. More specifically, the member 100 is formed of a first annular ring 102, a second annular ring 104, and a third annular ring 106. The first annular ring 102 is connected to a top wall 75 and the second annular ring 102 is concentrically disposed on the first annular ring 102 so that it protrudes thereaway. The first annular ring 102 has a first diameter and the second annular ring 104 has a second diameter with the first diameter being greater than the second diameter. The third annular ring 106 is concentrically disposed relative to the second annular ring 104 and protrudes thereaway. The third annular ring 106 has a third diameter which is less than the second diameter. The third annular ring 106 protrudes downward toward the output section 43 of the outer waveguide member 40; however, the third annular ring 106 would not contact the bottom wall 71 if this wall extended thereunderneath.

At the second intersection 61, the V polarity low band signals supported by the first and third waveguides 50, 60 and the H polarity low band signals supported by the second and fourth waveguides 52, 62 are recombined and then carried through the output section 43 of the outer waveguide member 40 as the signals are discharged from the waveguide assembly 10. As can be seen in FIGS. 3 and 4, the overlapping bridge structures of the assembly 10 permit one of the waveguides to pass over another of the waveguides. It will be understood that the specific shape of the illustrated waveguides 50, 52, 60, 62 is merely exemplary and the waveguides 50, 52, 60, 62 may have a number of shapes so long as the low band signals are launched into one of the paths 90, 92, 94, 96 and then recombined at a remote location within the same plane.

According to the present invention, the first phase length of the first waveguide 50 and the third phase of the third waveguide 60 differ from the second phase length of the second waveguide 52 and the fourth phase length of the fourth waveguide 62 by n(360°), where n=0, ±1, ±2, ±3, etc. In another embodiment, the first and third phase lengths differ from the second and fourth phase lengths by n(90°), where n=±1, ±3, ±5, etc. In yet another embodiment, the first and third phase lengths are not in phase with the second phase length.

According to the present invention, the waveguide 10 offers a waveguide structure where symmetry is maintained while at the same time, the waveguide 10 has a compact design so that is may be easily disposed between the feed horn and another component such as a radio. Because the waveguides 50, 52, 60, 62 lie substantially within the first plane which is substantially perpendicular to the axis of both the inner and outer waveguide members 30, 40 and the axis of the feed horn, the waveguide 10 does not comprise an elongated structure which extends coaxially relative to the input and output sections and the feed horn. Thus, the complexity and the overall size of the waveguide 10 is greatly reduced because of the orientation of a substantial portion of the waveguide 10 in the first plane which is perpendicular relative to the plane containing the other components, such as the feed horn and the radio.

In one aspect, the present invention provides a high performance package in which the radio is kept on center by keeping the transmit path(s), i.e., the inner waveguide member 30, on center and branching the receive paths 90, 92, 94, 96 out and over to the side. In other words, the receive paths 90, 92, 94, 96 are displaced from the transmit path (member 30). In many applications, it is desirable for a heavy transmit radio to be mounted on the center feed horn axis so that the radio is better supported, easier to adjust, and also is presented in a more aesthetically attractive package. If the waveguide 10 is hooked up to a radio, a circular polarizer (not shown) with typical square or circular waveguide input/outputs can be inserted between the section 73 of the inner waveguide member 30 and the radio to obtain dual circular polarity on transmit.

Figure 6:
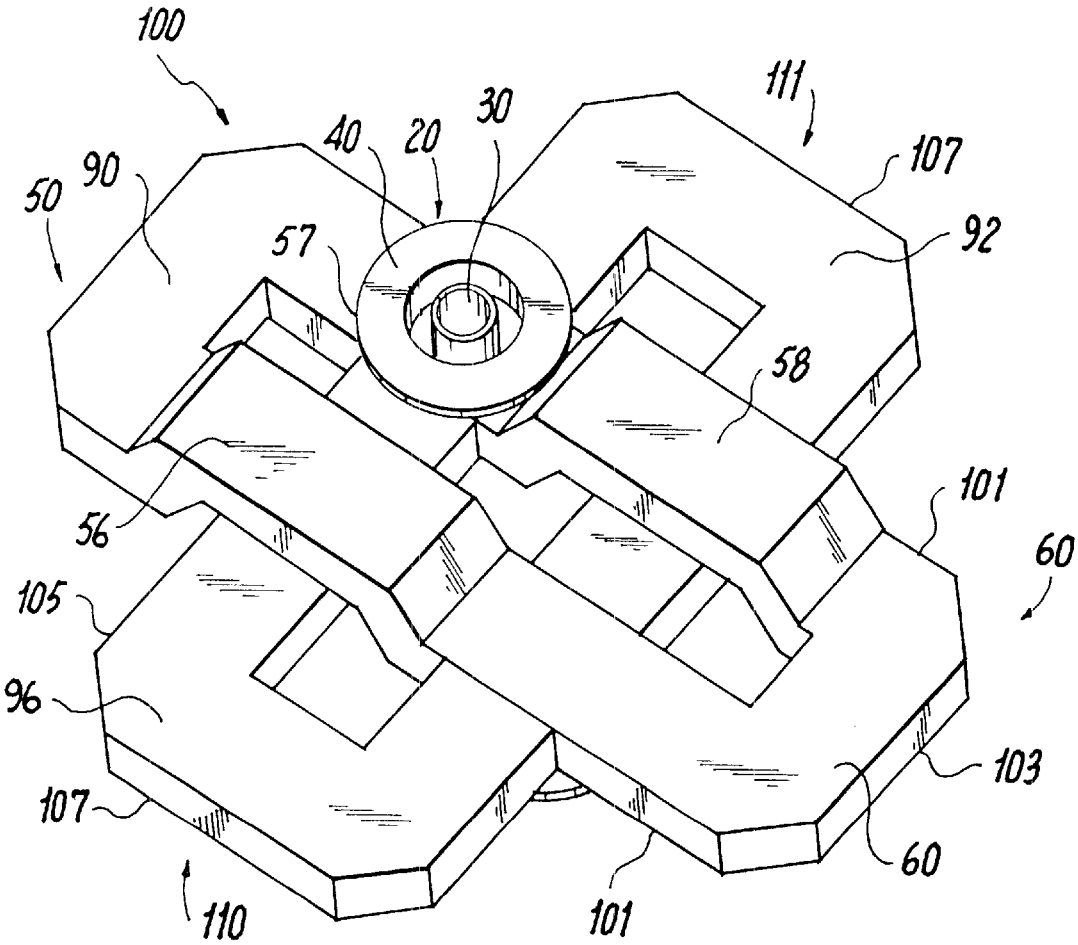
FIG. 6 is a top perspective view of a waveguide assembly according to a second embodiment of the present invention.
Figure 7:
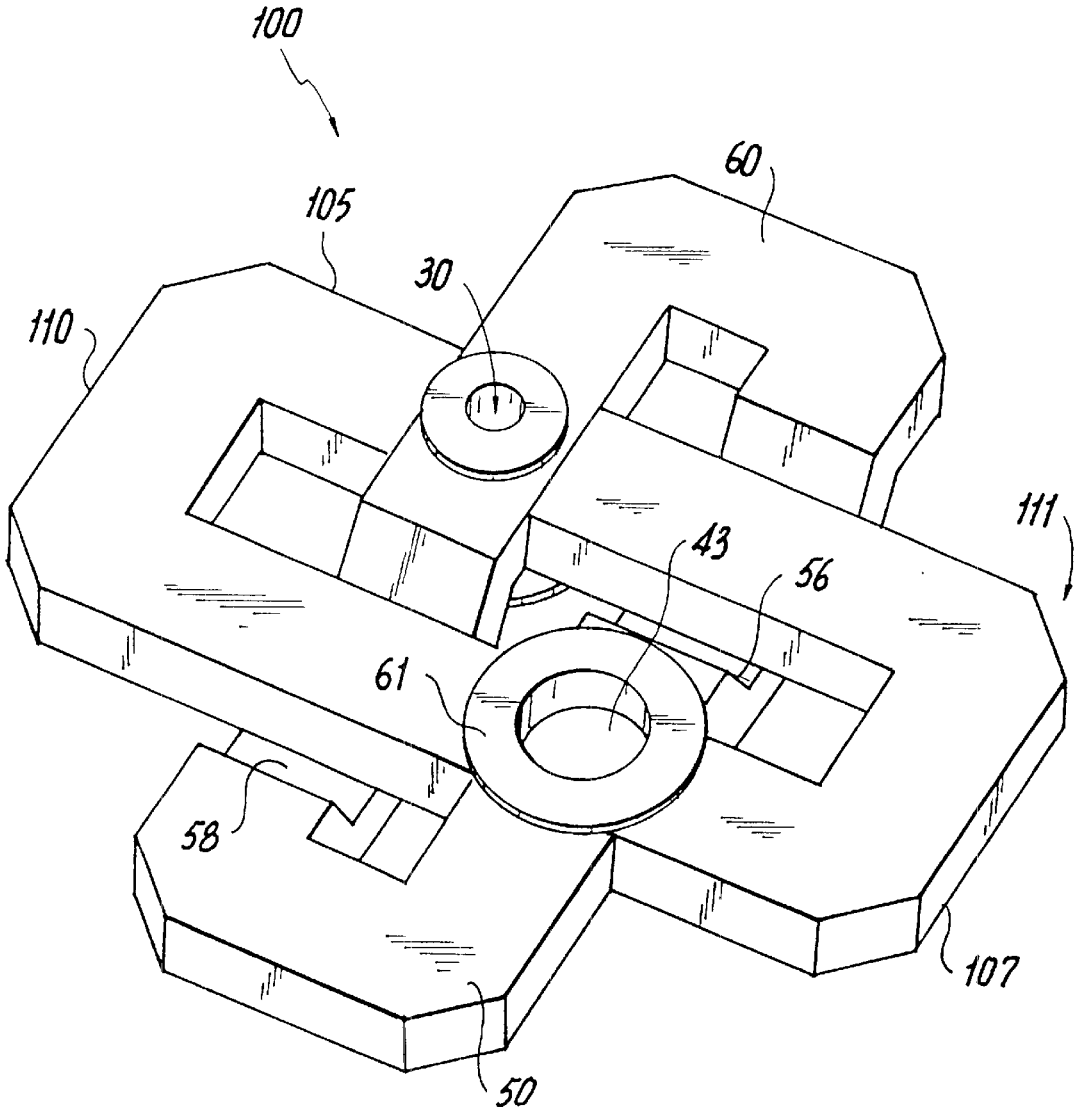
FIG. 7 is a bottom perspective view of the waveguide assembly of FIG. 6.

Now referring to FIGS. 6–7 in which a waveguide 100 according to another embodiment of the present invention is illustrated. The waveguide 100 is similar to the waveguide 10 with like elements being numbered alike. As with the waveguide 10, the waveguide 100 comprises a device in which the input port 20 includes the inner waveguide member 30 and the outer waveguide member 40. The input section 41 is coaxial to the inner waveguide member 30 and the output section 43 extends along an axis parallel and displaced from the axis of the member 30 and the input section 41. The waveguide 100 includes the first and third waveguides 50, 60; however, the second and fourth waveguides 52, 62 (FIG. 1) are replaced with a second waveguide 110 and fourth waveguide 111. The second and fourth waveguides 110, 111 are similar to the second and fourth waveguides 52, 62 with the exception that they do not include the first and second bridges 66, 68. That is to say, the second and fourth waveguides 110, 111 are defined by opposing side portions 105 and end portions 107 that lie within the same first plane. The waveguide 100 still has the first intersection 51 where the high and low band signals are separated and the second intersection 61 where the V and H polarity low band signals are recombined before exiting the waveguide 100. The first and second intersections 51, 61 lie within the same plane and therefore, the V and H polarity low band signals are launched and recombined in the same first plane but in different locations.

Because the second and fourth waveguides 110, 111 do not include any bridge sections, the path lengths defined by the second and fourth waveguides 110, 111 are less than the length of each of the first and third waveguides 50, 60 in one embodiment. The first bridge 56 serves to pass over a section of the second waveguide 110 and the second bridge 58 serves to pass over a section of the fourth waveguide 111. By intentionally configuring the lengths of the waveguides 50, 60, 110, 111; a 90° phase length difference between the H and V paths can be introduced intentionally so that the waveguide 100 supports circular polarity.

The first and third paths 90, 94 of the waveguides 50, 60 are thus symmetric and identical to one another and the second and fourth paths 92, 96 of the second and fourth waveguides 110, 111 are symmetric and identical to one another. The second path 92 extends from the input section 41 to the output section 43 and includes the portion of the second waveguide 110 which lies underneath the second bridge 58. The fourth path 96 extends from the input section 41 to the output section 43 and includes the portion of the fourth waveguide 111 which lies underneath the first bridge 56. When the lengths of the second and fourth waveguides 110, 111 are intentionally made shorter than the waveguides 50, 60, the length of the second and fourth paths 92, 96 will be less than the length of the first and third paths 90, 94. This results in the introduction of a 90° phase length difference between the H and V paths. The launch locations at the first intersection 51 and the recombining of the V and H polarity low band signals at the second intersection 61 are still both symmetric in nature.

It will be understood that waveguide 100 could just as equally be constructed so that the first and third waveguides 50, 60 do not include bridge structures 56, 58 but rather the second and fourth waveguides 110, 111 include the two bridges. The results obtained would be identical. In addition, if it is desired to maintain as much symmetry as possible, the length of the second and fourth waveguides 110, 111 may be increased so that each of the paths 90, 92, 94, 96 has the same length despite the fact that the first and third waveguides 50, 60 include bridge sections 56, 58 and the second and fourth waveguides 110, 111 do not. In this situation, the H and V polarity signals would not include a 90° phase length difference therebetween.

Figure 8:
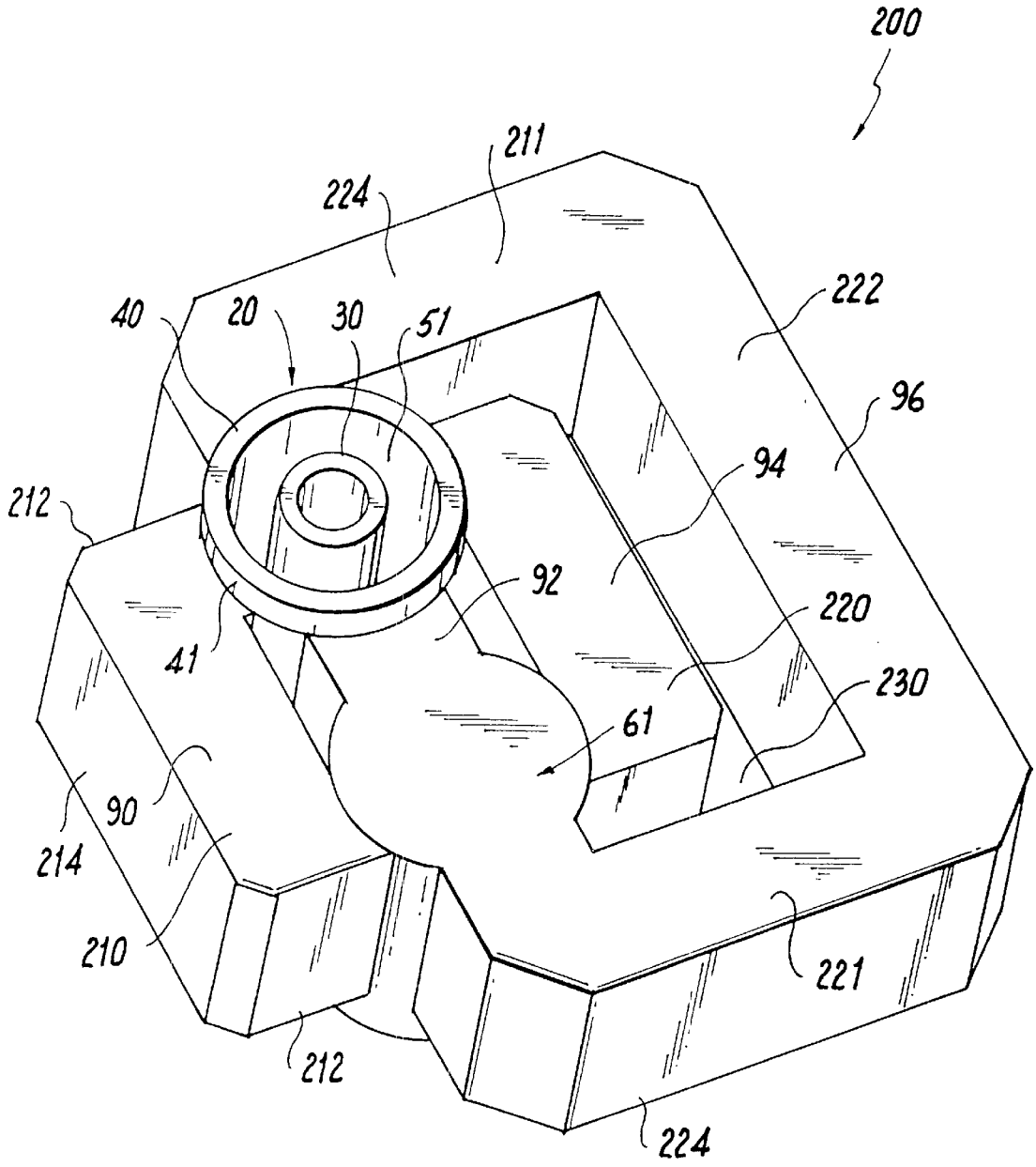
FIG. 8 is a top perspective view of a waveguide assembly according to a third embodiment of the present invention.
Figure 9:
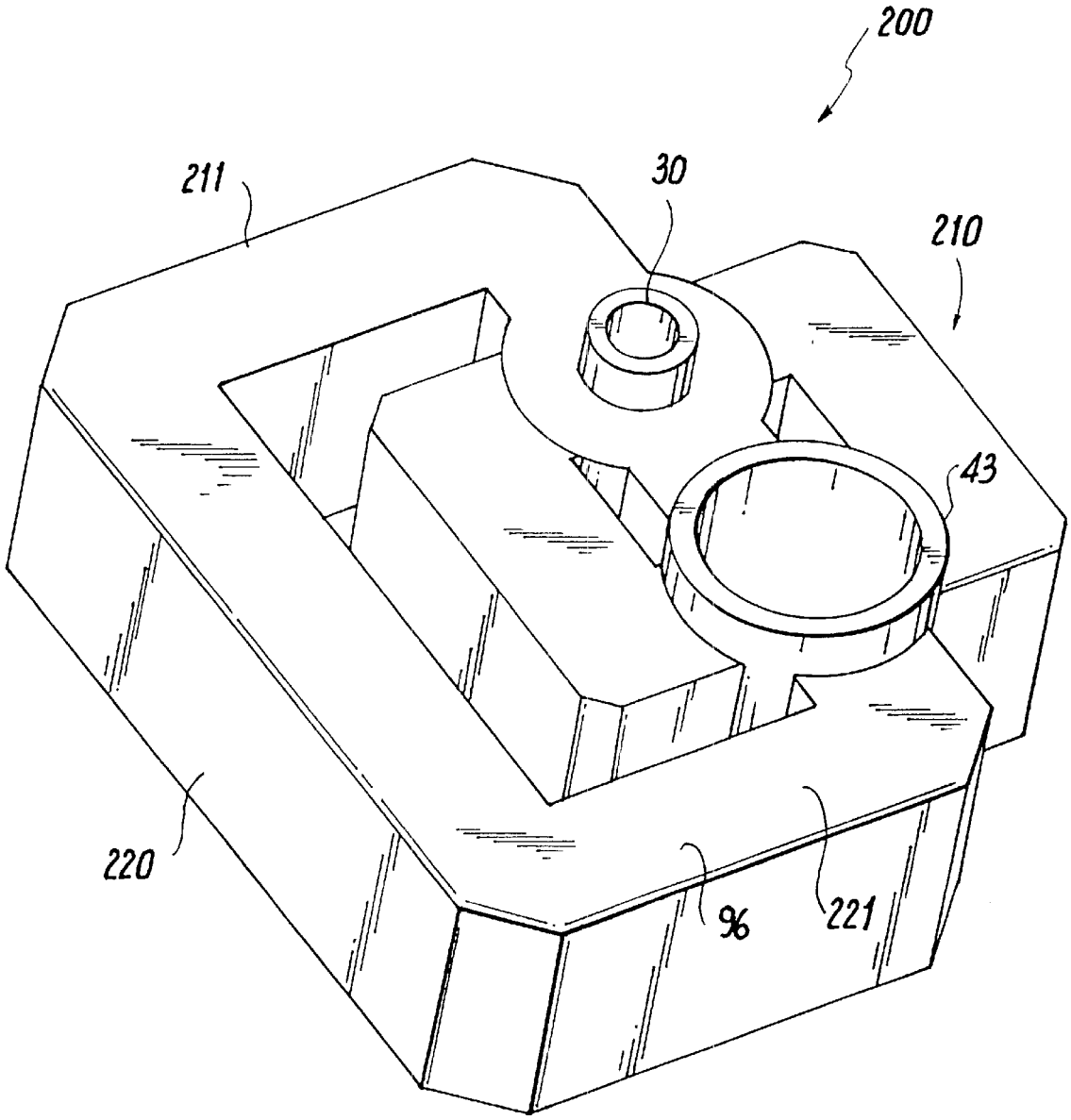
FIG. 9 is a bottom perspective view of the waveguide assembly of FIG. 8.

In yet another embodiment according to the present invention, a waveguide 200 is provided and illustrated in FIGS. 8 and 9. The waveguide 200 includes the input port 20 which is formed of the inner waveguide member 30 and the outer waveguide member 40 (defined by the input and output sections 41, 43). The inner waveguide member 30 along with the input section 41 are coaxial with the feed horn and the output section 43 is axially parallel to and displaced laterally from the member 30 and the input section 41. However, the input section 41 and the output section 43 are contained within the same first plane.

The waveguide 200 includes a first, second, third, and fourth waveguides 210, 211, 220, 221 which intersect one another at the first intersection 51 and the second intersection 61. The first intersection 51 comprises a four-way intersection where the first, second, third, and fourth paths 90, 92, 94, 96 are formed and serve to launch the H and V polarity low band signals from the input port 20. The first and third waveguides 210, 220 form a structure which is generally square shaped and defined by side portions 212 and end portions 214. The second and fourth waveguides 211, 221 form a generally "O" shaped structure which is defined by side portions 222 and end portions 224. The end portion 214 of the third waveguide 220 is disposed within an opening 230 formed between the side portions 222 and end portions 224 such that one of the side portions 222 extends across the side portions 212 within the same first plane. Accordingly, the first intersection 51 is formed at one of the side portions 212 and the second intersection 61 is formed at the other of the side portions 212.

The first and third waveguides 210, 220 define the first and third paths 90, 94 which are symmetric relative to one another and have the same length because the input section 41 and the output section 43 are formed at opposing locations along the side portions 212. The second and fourth waveguides 211, 221 define the second and fourth paths 92, 96 which connect the input section 41 to the output section 43. In contrast to the first and third waveguides 210, 220, the second and fourth paths 92, 96 are not the same lengths. The second path 92 extends from the input section 41 to the output section 43 along one of the side portions 222 and is not defined by either of the end portions 224. Thus, the second path 92 comprises a linear path along the side portion 222 which has the first and second intersections 51, 61 at ends thereof. The fourth path 96 extends from the input section 41 to the output section 43 and extends around both of the end portions 224 before converging at the second intersection 61 where the other paths also converge in a four-way manner. The fourth path 96 thus has a length which is greater than the length of the second path 92. In one exemplary embodiment, the first and third paths 90, 94 support the V polarity low band signals and the second and fourth paths 92, 96 support the H polarity low band signals. It being understood that the opposite may be equally true in that the coupling apertures provided at the location of the signal launching at the first intersection 51 may be designed so that the V polarity low band signals pass through the second and fourth paths 92, 96 and the H polarity low band signals pass through the first and third paths 90, 94.

Because it is desirable in many applications for the H and V low band signals to remain in-phase when the signals are combined at the second intersection 61, the length of the fourth path 96 is preferably expressed as being an integral multiple of the wavelength passed through the second path 92 so that the signal passing through the second path 92 and the signal passing through the fourth path 96 are in phase. By making the length of the fourth path 96 such that the difference in the path lengths is $n \times \lambda$, the signal passing through the fourth path 96 is in-phase when it is combined with the other signals at the second intersection 61.

As shown in FIG. 9, the output section 43 of the outer waveguide member 40 is axially parallel to the section 73 of the inner waveguide member 30 and is displaced therefrom so that the separation of the low band signals occurs at one location in the first plane and the recombination occurs at another location in the first plane.

Figure 10:
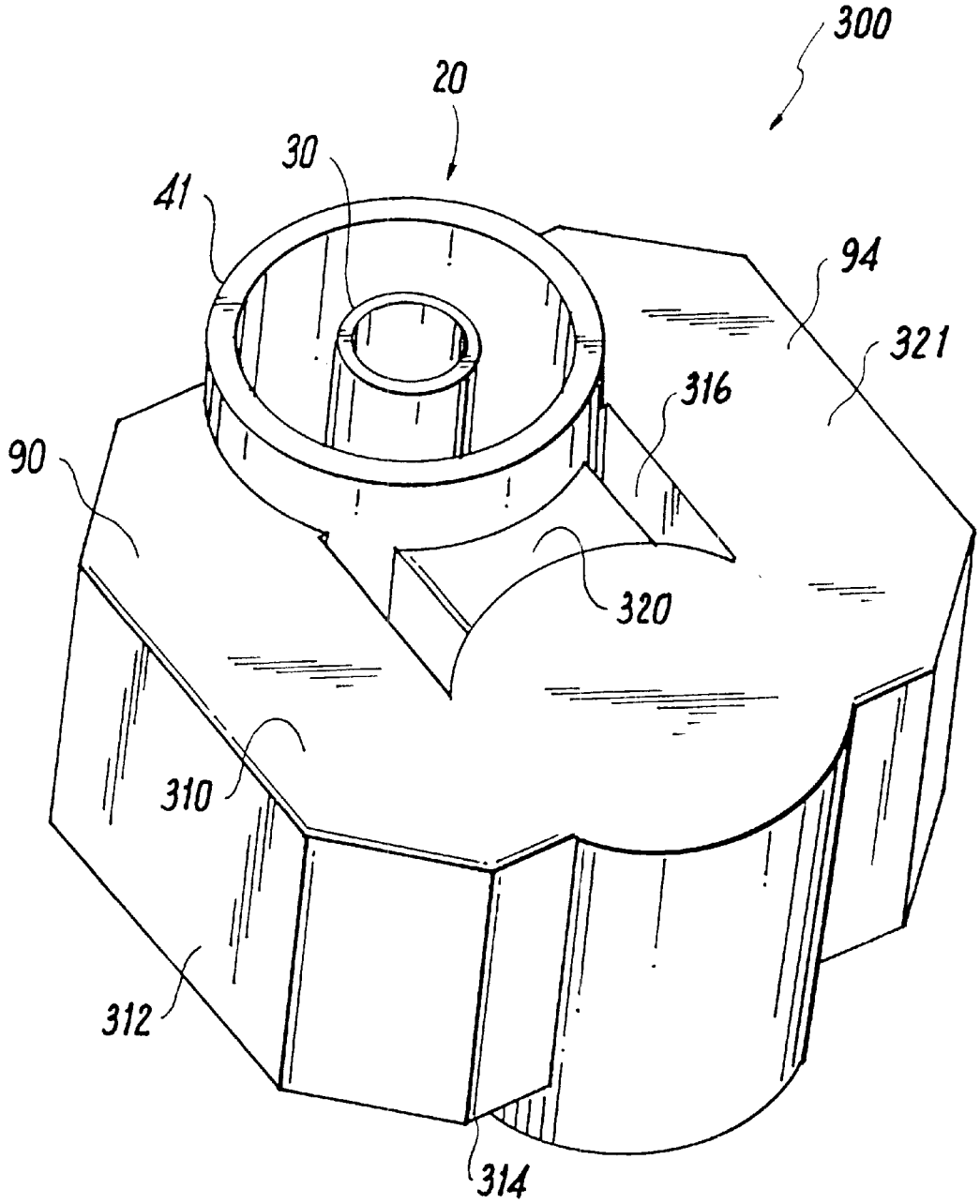
FIG. 10 is a top perspective view of a waveguide assembly according to a fourth embodiment of the present invention.
Figure 11:
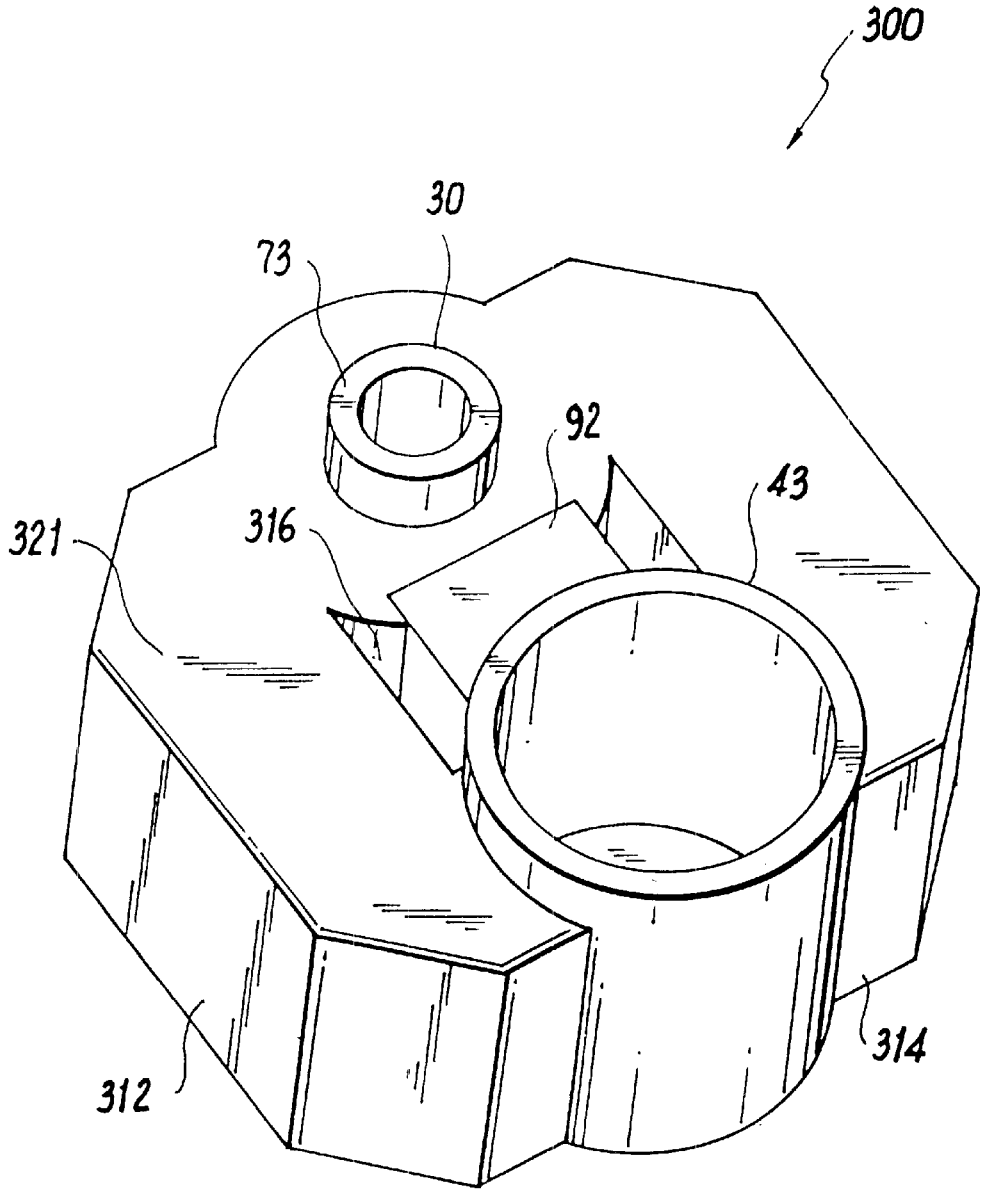
FIG. 11 is a bottom perspective view of the waveguide assembly of FIG. 10.

Now referring to FIGS. 10 and 11, in which an alternative embodiment of a waveguide structure according to the present invention is provided and generally indicated at 300. As with the other embodiments, this embodiment uses input port 20 which comprises the input section 41 of the outer waveguide member 40 and the inner waveguide member 30. The output section 43 of the outer waveguide member 40 is axially parallel to the coaxial input port 20 and displaced therefrom so that the low band signals are separated prior to exiting the waveguide 300 at another location. In this embodiment, the waveguide 300 includes only three waveguide paths 90, 92, 96 defined by a first waveguide 310, a second waveguide member 320, and a third waveguide 321.

The first and third waveguides 310, 321 form a generally square shaped structure defined by opposing side portions 312 and opposing end portions 314 with a center opening 316 being defined therebetween. The input port 20 is formed on one of the end portions 314 and the output section 43 is formed on the other of the end portions 314. In the exemplary embodiment, the input port 20 and the output section 43 comprise annular members with the components of the input port 20 being coaxial with one another. The second waveguide member 320 is in the form of a generally linear member which extends between the input port 20 and the output section 43 of the outer waveguide member 40. The second member 320 is thus generally disposed within the center opening 316.

As with the other embodiments, the H and V polarity high band signals are supported by the inner waveguide member 30 and travel therethrough without any separation thereof. The low band signals (H and V polarity) are separated and launched at a first intersection between one end of the second waveguide 320 and one end portion 314 and then recombined at a second intersection between the other end of the second waveguide 320 and the other end portion 314. The first and second intersections are thus each a three-way intersection. At each intersection, there are three coupling apertures (not shown) which serve to receive or transmit the respective signal when the waveguide 300 is in the correct position.

In this embodiment, the first and third waveguides 310, 321 form the first and third paths 90, 94, respectively, and the second waveguide 320 forms the second path 92. The first path 90 extends from the input section 41 along one of the side portions 312 to the output section 43 and the third path extends from the input section 41 along the other of the side portions 312 to the output section 43. Each of the first and third paths 90, 94 is accordingly U-shaped. At the first intersection, the first and third paths 90, 94 generally oppose one another such that the third path 94 is about 180° from the first path 90. The signals being received within the first and third paths 90, 94 comprise signals having the same polarity. The first and thirds paths 90, 94 are designed to receive low band signals having a first polarization (i.e., V band) and the second path 92 is designed to receive low band signals having a second polarization (i.e., H band).

The second path 92 is formed at about a 90° angle relative to each of the first and third paths 90, 94 and thus is designed to receive the H polarity low band signals. Because this embodiment does not include a fourth path, the H polarity low band signals are not separated but rather all of these signals are supported by the second waveguide 320 and second path 92 defined thereby. The second path 92 comprises a fairly linear path between the input port 20 and the output section 43 of the outer guide member 40.

The first and third paths 90, 94 are symmetric relative to one another and the length of the first path 90 is preferably equal to the length of the third path 94. This symmetry and equal path lengths permit the V polarity low band signals to be launched at the first intersection and then recombined at the second intersection preferably without altering the phases of the signals. This is all accomplished within the same first plane. The length of the second path 92 is preferably less than the lengths of the first and third paths 90, 94.

The embodiments of the present invention, provide a compact waveguide structure in which the low band signals are separated by polarity and then recombined within the same plane but at different remote locations. The input section 41 and the output section 43 each have an axis which is either coaxial (in the case of the input section 41) or parallel (in the case of the output section 43) to the feed horn axis. The first and second waveguide members forming the waveguide assembly 10 are disposed in a plane perpendicular to the axis of each of the feed horn and the input and output sections 41, 43, respectively.

One of the advantages provided by the waveguides of FIGS. 6, 7, 10, and 11 is that these waveguides support H and V linear polarities provided the waveguide launches (paths 90, 92, 94, 96) are aligned with the incoming polarity of the signal carried within the input port 20. It will be appreciated by one of skill in the art that all of the embodiments of the present invention can support linear and circular polarity signals provided proper path length and phasing is chosen between the waveguide members defining the paths 90, 92, 94, 96. Opposing waveguide paths (i.e. first and third paths 90, 94) are always in-phase and adjacent sets of waveguide paths are 90° out of phase for circular polarity. FIGS. 16A–D show alternative configurations for the waveguide assembly 300. In each of these alternative configurations, there are three waveguides, namely the first, second, and third waveguides 310, 320, 321. The waveguide paths for the respective waveguides 310, 320, 321 may be varied by tailoring the length and shape of each of the waveguides 310, 320, 321. It will be appreciated that there are any number of other configurations that may be used in constructing the waveguide assembly 300.

Figure 12:
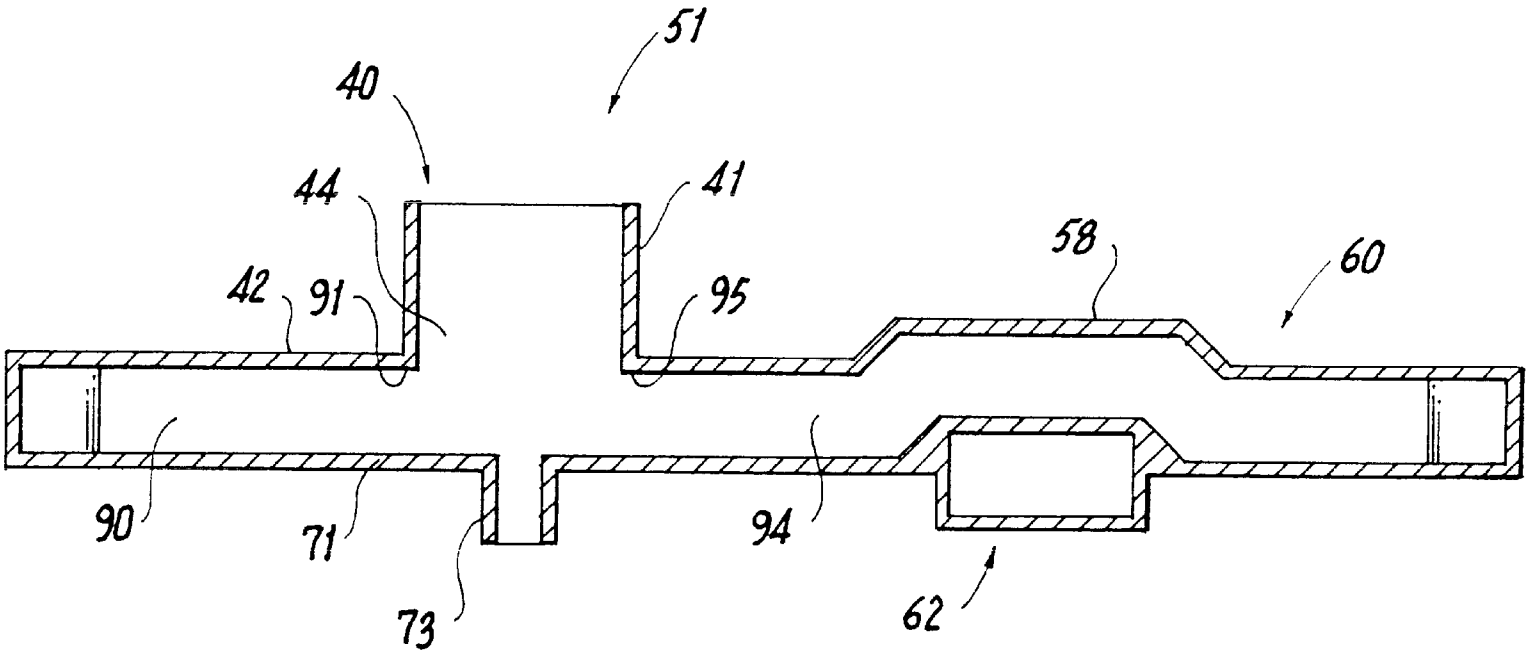
FIG. 12 is a cross-sectional view of a waveguide assembly according to a fifth embodiment where the input waveguide includes only an outer member for supporting both first and second band signals.

FIG. 12 is a cross-sectional view of a fifth embodiment which is similar to the first embodiment of FIG. 3 with the exception that the inner guide member 30 is eliminated. In other words, the input port 20 is formed of only the outer guide member 40, which is configured to support both the first and second band signals. As in the first embodiment, the section 73 is configured so that it either receives or transmits the V and H polarity high band signals depending upon the precise application of the waveguide assembly 10. The V and H polarity low band signals are fed into the coupling apertures 91, 95 and the coupling apertures (not shown) associated with the second and fourth paths 92, 96. It will be further appreciated that in this embodiment, a dielectric material may be disposed within the outer guide member 40. While the annular support member 80 described in reference to the first embodiment is not shown in FIG. 12, this member may be incorporated into the waveguide shown in FIG. 12 so as to provide a means for directing the V and H polarity low band signals into one of the respective waveguides paths 90, 92, 94, 96. It will be further appreciated that the input port 20 shown in FIG. 12 may be incorporated into any of the previous embodiments shown in FIGS. 1–11.

Figure 13:
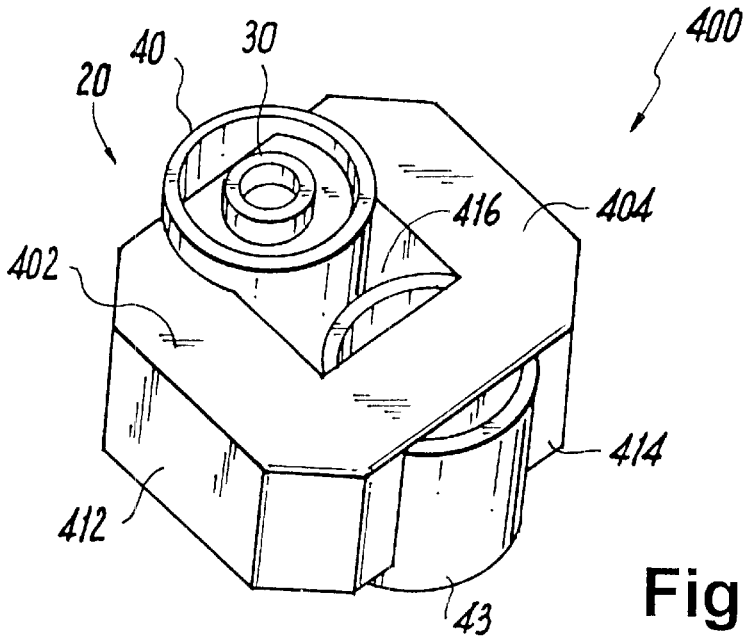
FIG. 13 is a top perspective view of a waveguide assembly according to a sixth embodiment of the present invention.
Figure 14:
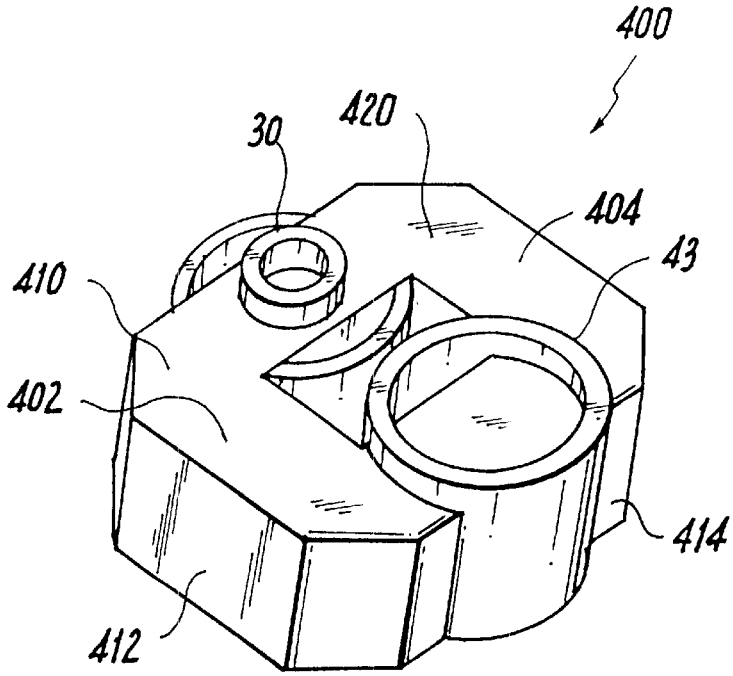
FIG. 14 is a bottom perspective view of the waveguide assembly of FIG. 13.

Now referring to FIGS. 13–14 in which a waveguide 400 according to a sixth embodiment of the present invention is shown. The waveguide 400 is configured so that it supports a first band signal having one or more polarities and a second band signal having only a single polarity. In this embodiment, the input port 20 is provided and includes at least the outer waveguide member 40 and optionally includes the inner waveguide member 30. The output section 43 of the outer waveguide member 40 is axially parallel to the coaxial input port 20 and displaced therefrom so that the single polarity low band signals are separated prior to exiting the waveguide 400 at another location defined by the output section 43.

In this embodiment, the waveguide 400 only includes first and second waveguide paths 402 and 404 defined by a first waveguide 410 and a second waveguide 420, respectively. In the assembled state, the first and second waveguides 410, 420 form a generally square shaped structure defined by opposing side portions 412 and opposing end portions 414 with a center opening 416 being defined therebetween.

As with the other embodiments, the one or more polarity high band signals are supported by the inner waveguide member 30 and travel therethrough. For example and according to one embodiment, the high band signals includes signals of two polarities, namely H and V polarities; however, a single polarity high band signal may also be received and travel therethrough. In this embodiment, the low band signal only has a single polarity. The single polarity low band signal is separated and launched at a first intersection at first ends of the first and second waveguides 410, 420 and then are later recombined at a second intersection at opposite second ends of the first and second waveguides 410, 420. The first and second intersections are thus two-way intersections. At each intersection there are two coupling apertures (not shown) which serve to receive the low band signals in the case of the first intersection and recombine the low band signals in the case of the second intersection. Because only a single polarity is supported by the first and second waveguides 410, 420, the coupling apertures are 180° apart from one another. The launching and then later recombining of the low band signals is also done in the same plane. In other words, the first and second waveguides 410, 420 are contained within the same plane.

In this embodiment, the first path 402 extends from the input section 41 along one of the side portions 412 to the output section 43 and the second path 404 extends from the input section 41 along one of the side portions 412 to the output section 43. Each of the first and second paths 402, 404 are generally U-shaped. At each of the first and second intersections, the first and second paths 402, 404 oppose one another. As with the other embodiments, the waveguide 400 is symmetric in that the first and second paths 402, 404 have the same shape and also have the same length as the output section 43 is generally 180° away from the input section 41.

Figure 15A:
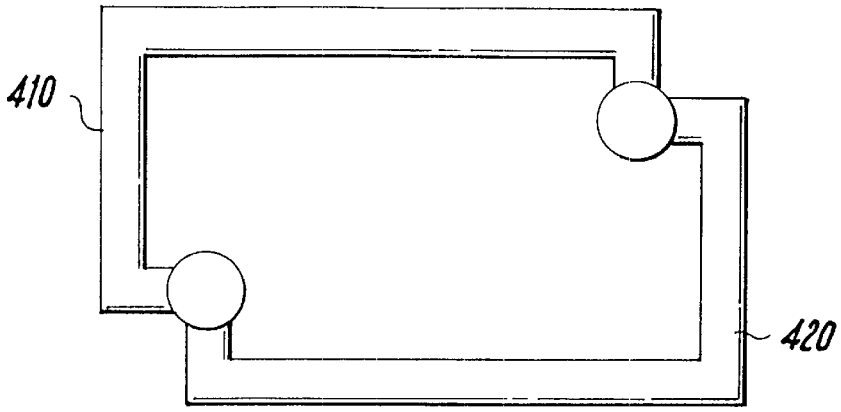
FIGS. 15A–C are top plan views of alternative waveguide assemblies having two waveguide members.
Figure 15B:
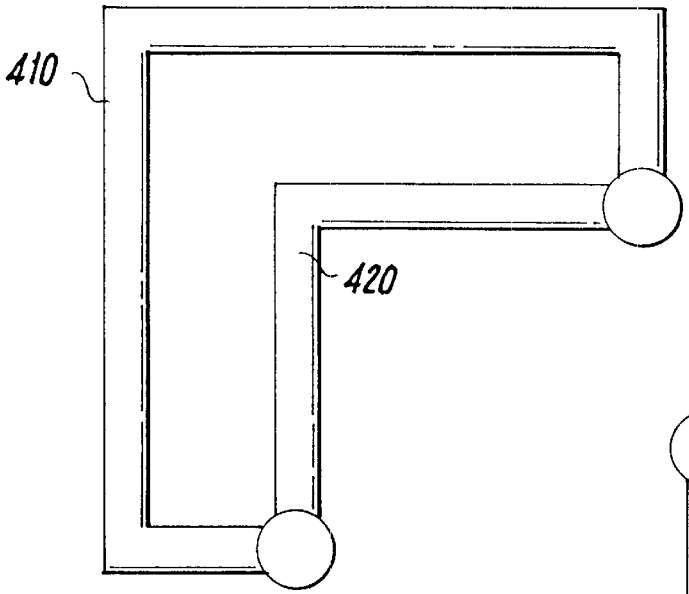
Figure 15C:
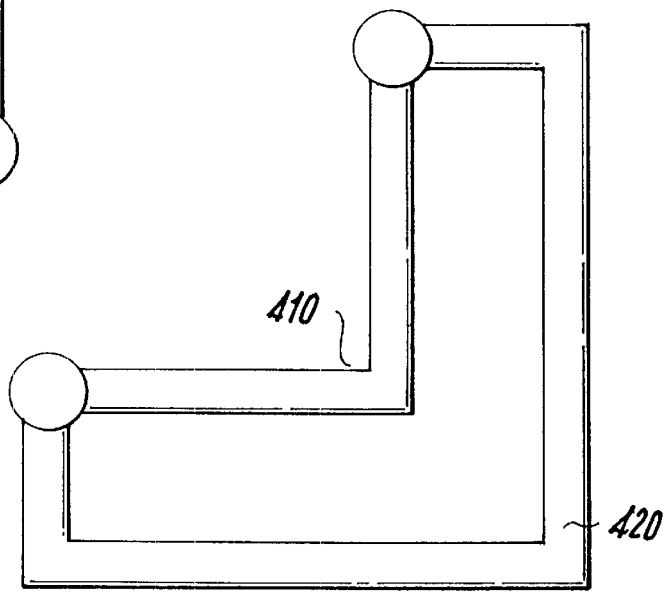
Figure 16A:
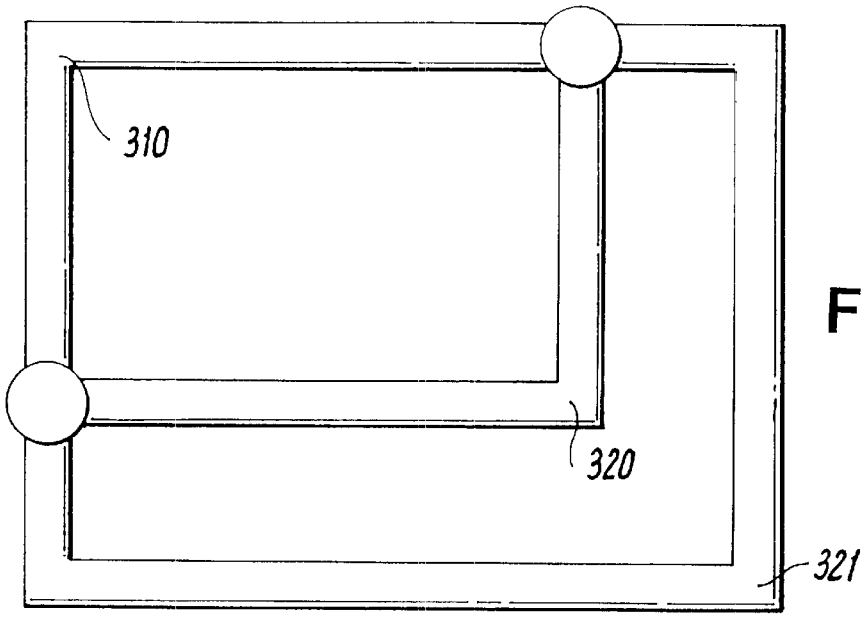
FIGS. 16A–D are top plan views of alternative waveguide assemblies having three waveguide members.
Figure 16B:
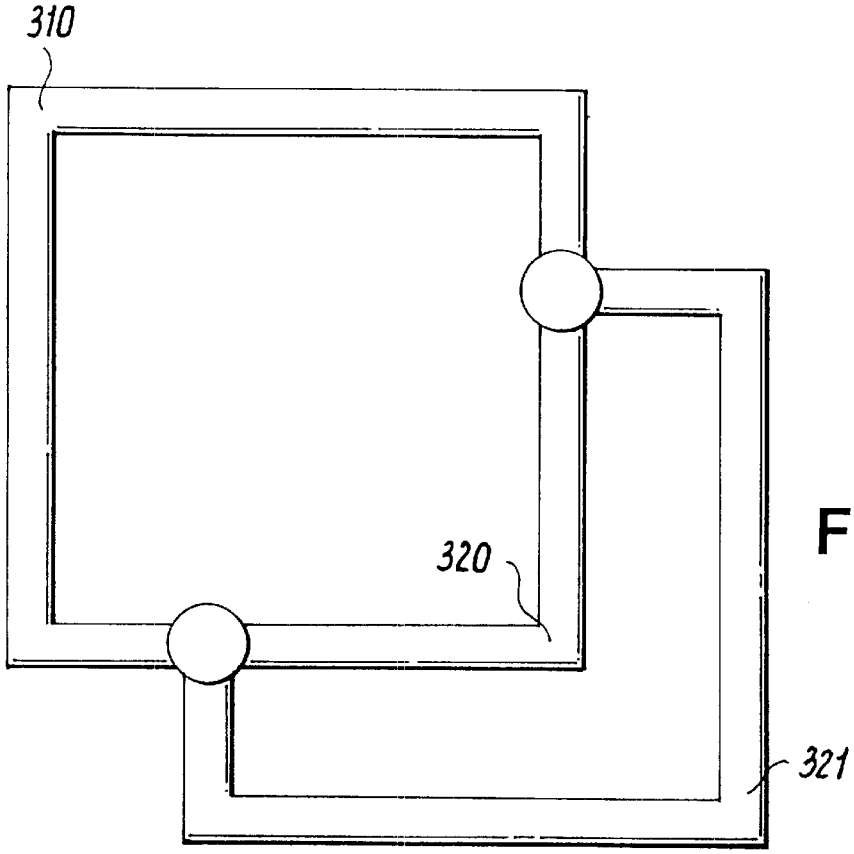
Figure 16C:
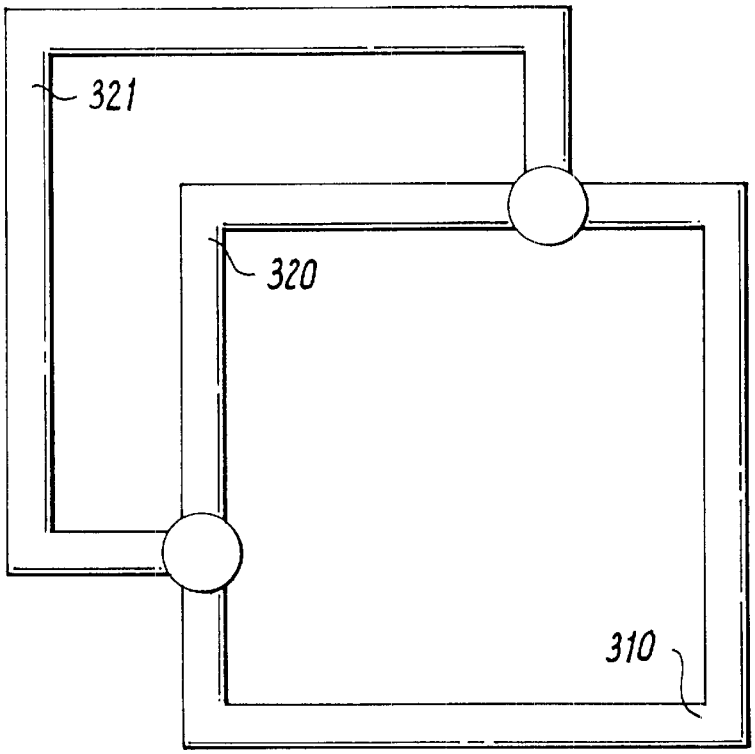
Figure 16D:
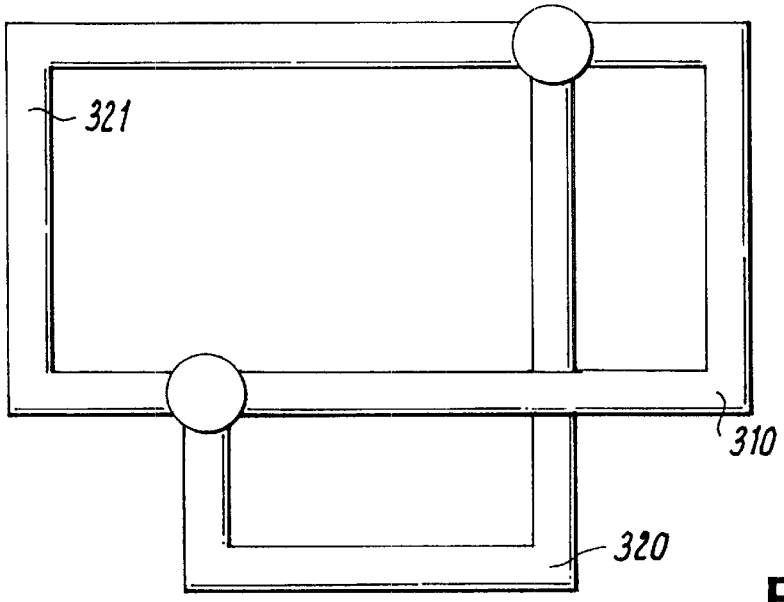

FIGS. 15A–C show alternative configurations for waveguide 400. However, in each of these embodiments, there are two waveguide members 410, 420 used, as in the embodiment of FIGS. 13 and 14. It will be appreciated that the waveguide 400 may be formed according to any number of configurations and those shown in FIGS. 15A–C are merely exemplary.

It will be appreciated that while the first band signal has been described as being a high band signal, the opposite is true in that the first band signal may be a low band signal. Similarly, the second band signal is not limited to being a low band signal and may also be a high band signal when the first band signal is the low band signal. In this alternative embodiment, the low band signal is carried straight through a waveguide, while the high band signal is separated out and carried within two or more waveguides before being later recombined. It will further be appreciated that in all of the embodiments of the present invention, except the embodiment of FIGS. 13–14, the first and second polarity band signal which are launched into two or more waveguides may be launched such that one polarity is launched in a first plane and then later recombined in the same first plane, while the other polarity is launched in a second plane and is later recombined in the same second plane.

Although the present invention has been described in terms of dual (H and V) polarity for both high and low bands (transmit and receive), it is within the scope of the present invention that the waveguides disclosed herein may be used for a variety of dual band polarity scenarios. These scenarios include but are not limited to: transmit single polarity and receive single polarity; transmit single polarity and receive dual polarity; transmit dual polarity and receive single polarity; transmit dual polarity and receive dual polarity. If only one set of receive polarity is needed then only one set of waveguide paths is needed. If only one transmit polarity is needed then the inner waveguide member 30 will transition to a rectangular or other shaped waveguide.

Furthermore, while the present invention has been described as combining both receive polarities (H and V low band signals) into a single circular or square waveguide (input port 20), it will be understood that the two receive polarities may remain separated. In this instance, the two waveguide paths containing the V polarity low band signals would be combined into an output port (e.g., rectangular port) on one side of the device and the two waveguide paths containing the H polarity low band signals would be combined into another output (rectangular) port on the other side of the device. Two separate LNBs (low noise blockconverters) would then be connected to each receive port or an LNB with two separate rectangular port input ports could also be used. The orientation and method of combining the opposing waveguides into two polarity rectangular ports is flexible (a 180 phase difference in the path lengths may be necessary for linear polarity depending upon the method of the combination).

In addition, while the preferred feed horn comprises a coaxial feed horn, the waveguides of the present invention may be implemented with other types of feed horns. For example, some frequency bands are not separated enough to use the coaxial feed horn approach and instead a single broadband feed horn must support both the transmit and receive bands. It is contemplated that waveguides embodying the present invention may be interfaced directly with a broad band horn when the waveguide is properly customized for such use. In this instance, the transmit and receive bands will be essentially separated in the same manner as when a coaxial feed horn is used. If the transmit and receive bands are relatively close together then location of specific filtering in the receive branches may be necessary.

The present invention thus provides several embodiments of waveguide assemblies in which the two polarities of the low band signals are launched into waveguide members and then recombined in the same plane. The launch sites are preferably symmetric in nature and in order to optimize symmetry of the assembly, the waveguide members cross over one another in a basket weave manner. It is within the scope of the present invention that the waveguide members may be E-plane or H-plane oriented. Advantageously, the assemblies of the present invention may be used in complex applications, such as satellite reflection antenna applications. Other components, such as a radio and feed horn, may be kept on center by keeping the transmit path(s) on center and branching the receive lines out and over to the side. This provides a compact design which may be used in a variety of applications and settings.

While the invention has been particularly shown and described with reference to preferred embodiments thereof, it will be understood by those skilled in the art that various changes in form and details may be made therein without departing from the spirit and scope of the invention.

We claim:

1. A waveguide device comprising:

an input waveguide aligned along a first axis and configured to carry a first band signal having first and second polarities and a second band signal having first and second polarities, the first band signal being discharged through an output which is coaxial with the input waveguide, the input waveguide for coaxial alignment with a feed horn;

an output waveguide for supporting and discharging the second band signal, the output waveguide being spaced from the input waveguide and extending along a second axis which is parallel to the first axis containing the input waveguide, the first axis being displaced from the second axis such that the second axis and the input waveguide are arranged in a nonintersecting manner; and first and second waveguides connecting the input waveguide to the output waveguide, the first waveguide supporting the first polarity of the second signal, the second waveguide supporting the second polarity of the second signal, the first and second waveguides being disposed substantially perpendicular to the input and output waveguides along a length of each such that the second band signal is fed into the input waveguide and then separated therefrom and carried within the first and second waveguides, before being discharged through the output waveguide.

2. The waveguide device of claim 1, wherein the first and second waveguides are orientated so that the second band signal is launched into the first and second waveguides and later recombined from the first and second waveguides within the same plane.

3. The waveguide device of claim 1, wherein the input waveguide includes coaxial inner and outer members, the inner member configured to carry the first band signal and the outer member configured to carry the second band signal, wherein the output in which the first band signal is discharged is coaxial with an input of the inner member which receives the first band signal.

4. The waveguide device of claim 1, wherein the first band signal comprises a high band signal having associated first and second polarity vectors which differ from one another by a predetermined angle.

5. The waveguide device of claim 4, wherein the predetermined angle is 90°.

6. The waveguide device of claim 1, wherein the second band signal comprises a low band signal having associated first and second polarity vectors which differ from one another by a predetermined angle.

7. The waveguide device of claim 6, wherein the predetermined angle is 90°.

8. The waveguide device of claim 1, wherein the first waveguide has a first coupling aperture configured to pass the first polarity of the second band signal and reject the second polarity of the second band signal, the second waveguide having a second coupling aperture configured to pass the second polarity of the second band signal and reject the first polarity of the second band signal.

9. The waveguide device of claim 1, wherein the first and second waveguides intersect one another at a first intersection where the input waveguide is formed and at a second intersection where the output waveguide is formed.

10. The waveguide device of claim 1, wherein the first and second waveguides are each symmetric relative to one another.

11. The waveguide device of claim 1, wherein the first waveguide defines a first phase length and the second waveguide defines a second phase length.

12. The waveguide device of claim 11, wherein the first phase length differs from the second phase length by n(360°), where n is an integer.

13. The waveguide device of claim 11, wherein n=0 resulting in the first phase length being in phase and equaling the second phase length.

14. The waveguide device of claim 11, wherein the first and second phase lengths are different.

15. The waveguide device of claim 11, wherein the first phase length differs from the second phase length by n(90°), where n is an odd integer.

16. A waveguide device comprising:

an input waveguide aligned along a first axis and configured to carry a first band signal having first and second polarities and a second band signal having first and second polarities, the first band signal being discharged through an output which is coaxial with the input waveguide, the input waveguide for coaxial alignment with a feed horn;

an output waveguide for supporting and discharging the second band signal, the output waveguide being spaced from the input waveguide and extending along a second axis which is parallel to the first axis containing the input waveguide, the first axis being displaced from the second axis such that the second axis and the input waveguide are arranged in a nonintersecting manner; and first, second, third and fourth waveguides connecting the input waveguide to the output waveguide, the first and third waveguides supporting the first polarity of the second signal, the second and fourth waveguides supporting the second polarity of the second signal, each of the waveguides being disposed substantially perpendicular to the input and output waveguides along a length of each such that the second band signal is fed into the input waveguide and then separated therefrom by being carried within a first plane, defined by sections of the first, second, third and fourth waveguides, before being discharged through the output waveguide.

17. The waveguide device of claim 16, wherein the input waveguide includes coaxial inner and outer members, the inner member configured to carry the first band signal and the outer member configured to carry the second band signal, wherein the output in which the first band signal is discharged is coaxial with an input of the inner member which receives the first band signal.

18. The waveguide device of claim 16, wherein the second band signal comprises a low band signal having associated first and second polarity vectors which differ from one another by a predetermined angle.

19. The waveguide device of claim 18, wherein the predetermined angle is 90°.

20. The waveguide device of claim 16, wherein the first waveguide has a first coupling aperture and the third waveguide has a third coupling aperture both being configured to pass the first polarity of the second band signal and reject the second polarity of the second band signal, the second waveguide having a second coupling aperture and the fourth waveguide having a fourth coupling aperture both being configured to pass the second polarity of the second band signal and reject the first polarity of the second band signal.

21. The waveguide device of claim 16, wherein the first, second, third, and fourth waveguides intersect one another at a first intersection where the input waveguide is formed and at a second intersection where the output waveguide is formed.

22. The waveguide device of claim 16, wherein the first, second, third and fourth waveguides are each symmetric relative to one another.

23. The waveguide device of claim 16, wherein the first waveguide defines a first phase length, the second waveguide defines a second phase length, the third waveguide defines a third phase length, and the fourth waveguide defines a fourth phase length.

24. The waveguide device of claim 23, wherein each of the first, second, third, and fourth phase lengths are equal.

25. The waveguide device of claim 23, wherein the first phase length differs from the third phase length by n(360°), where n is an integer and the second phase length differs from the fourth phase length by n(360°), where n is an integer.

26. The waveguide device of claim 25, wherein the first and third phase lengths differ from the second and fourth phase lengths by n(360°), where n is an integer.

27. The waveguide device of claim 23, wherein the first and third phase lengths differ from the second and fourth phase lengths by n(90°), where n is an odd integer.

28. The waveguide device of claim 23, wherein the first and third phase lengths are not in phase with the second and fourth phase lengths.

29. The waveguide device of claim 16, wherein the first and second waveguides cross over one another and the third and fourth waveguides cross over one another so that each of the first, second, third, and fourth waveguides has an equal phase length.

30. The waveguide device of claim 16, wherein the input waveguide and output waveguide each comprises one of a circular, square, and octagonal waveguide.

31. The waveguide device of claim 16, wherein the first, second, third and fourth waveguides converge at the output waveguide resulting in the first and second polarity second band signals being recombined in the first plane prior to being discharged in a direction perpendicular relative to the first plane.

32. A waveguide device comprising:

an input waveguide aligned along a first axis and configured to carry a first band signal having first and second polarities and a second band signal having first and second polarities, the first band signal being discharged through an output which is coaxial with the input waveguide, the input waveguide for coaxial alignment with a feed horn;

an output waveguide for supporting and discharging the second band signal, the output waveguide being spaced from the input waveguide and extending along a second axis which is parallel to the first axis containing the input waveguide, the first axis being displaced from the second axis such that the second axis and the input waveguide are arranged in a nonintersecting manner; and first, second, and third waveguides connecting the input waveguide to the output waveguide, the first and third waveguides supporting the first polarity of the second signal, the second waveguide supporting the second polarity of the second signal, each of the waveguides being disposed substantially perpendicular to the input and output waveguides along a length of each such that the second band signal is fed into the input waveguide and then separated therefrom by being carried within a first plane, defined by the first, second, and third waveguides, before being discharged through the output waveguide.

33. A waveguide device comprising:

an input waveguide aligned along a first axis and configured to carry a first band signal having first and second polarities and a second band signal having first and second polarities, the first band signal being discharged through an output which is coaxial with the input waveguide, the input waveguide for coaxial alignment with a feed horn;

an output waveguide for supporting and discharging the second band signal, the output waveguide extending along a second axis which is parallel to the first axis containing the input waveguide but displaced therefrom; and first, second, and third waveguides connecting the input waveguide to the output waveguide, the first and third waveguides supporting the first polarity of the second signal, the second waveguide supporting the second polarity of the second signal, each of the waveguides being disposed substantially perpendicular to the input and output waveguides such that the second band signal is fed into the input waveguide and then separated therefrom by being carried within a first plane, defined by the first, second, and third waveguides, before being discharged through the output waveguide.

34. The waveguide device of claim 33, wherein the input waveguide includes coaxial inner and outer members, the inner member configured to carry the first band signal and the outer member configured to carry the second band signal, wherein the output in which the first band signal is discharged is coaxial with an input of the inner member which receives the first band signal.

35. The waveguide device of claim 33, wherein the first waveguide defines a first phase length, the second waveguide defines a second phase length and the third waveguide defines a third phase length.

36. The waveguide device of claim 35, wherein the first phase length differs from the third phase length by n(360°), where n is an integer.

37. The waveguide device of claim 35, wherein each of the first, second and third phase lengths is in phase with another, the phase lengths of each of the first, second, and third phase lengths differing from one another by n(360°), where n is an integer.

38. The waveguide device of claim 35, wherein the first and third phase lengths differ from the second phase length by n(90°), where n is an odd integer.

39. A waveguide device comprising:

a first waveguide aligned along a first axis and configured to carry a first band signal having first and second polarities and a second band signal having first and second polarities, the first band signal being discharged through an output which is coaxial with the first waveguide;

a second waveguide for supporting and discharging the second band signal, the second waveguide being spaced from the first waveguide and extending along a second axis which is parallel to the first axis containing the first waveguide, the first axis being displaced from the second axis such that the second axis and the first waveguide are arranged in a nonintersecting manner; and third and fourth waveguides connecting the first waveguide to the second waveguide, the third waveguide supporting the first polarity of the second signal, the fourth waveguide supporting the second polarity of the second signal, the third and fourth waveguides being disposed substantially perpendicular to the first and second waveguides along a length of each such that the second band signal is fed into one of the first and second waveguides and then separated therefrom with the first polarity second band signal being carried within a first plane defined by the third waveguide and the second polarity second band signal being carried within a second plane defined by the fourth waveguide, the first and second polarity second band signals being recombined from the third and fourth waveguides and then discharged through the other of the first and second waveguides.

40. The waveguide device of claim 39, wherein the first plane and the second plane are coplanar.

41. The waveguide device of claim 39, wherein the first polarity second band signal is launched from one of the first and second waveguides into the third waveguide at a first launch location and the second polarity second band signal is launched from one of the first and second waveguides into the fourth waveguide at a second launch location.

42. The waveguide device of claim 41, wherein the first and second launch locations are contained within the same plane.

43. The waveguide device of claim 41, wherein the first launch location is within the first plane and the second launch location is within the second plane.

44. The waveguide device of claim 43, wherein the first and second planes are different planes.

* * * * *